US010782629B2

(12) United States Patent
Hwang et al.

(10) Patent No.: US 10,782,629 B2
(45) **Date of Patent: *Sep. 22, 2020**

(54) IMAGE FORMING APPARATUS AND METHOD FOR CONTROLLING THE SAME

(71) Applicant: Hewlett-Packard Development Company, L.P., Spring, TX (US)

(72) Inventors: Jeongwon Hwang, Seongnam-si (KR); Youngmin Yoon, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/653,192

(22) Filed: Oct. 15, 2019

(65) Prior Publication Data

US 2020/0041925 A1 Feb. 6, 2020

Related U.S. Application Data

(63) Continuation of application No. PCT/KR2018/005483, filed on May 14, 2018, which (Continued)

(30) Foreign Application Priority Data

May 25, 2017 (KR) ..... 10-2017-0064678

(51) Int. Cl.
*G03G 15/043* (2006.01)
*G03G 15/00* (2006.01)
(Continued)

(52) U.S. Cl.
CPC ... *G03G 15/0435* (2013.01); *G03G 15/04036* (2013.01); *G03G 15/1605* (2013.01);
(Continued)

(58) Field of Classification Search
CPC ..... G03G 15/5054; G03G 15/5058; G03G 15/5062; G03G 2215/00042;
(Continued)

(56) References Cited

U.S. PATENT DOCUMENTS 7,792,458 B2 9/2010 Ota
7,917,060 B2 3/2011 Miura
(Continued)

FOREIGN PATENT DOCUMENTS

JP H0816067 A 1/1996
JP 2007245480 A 9/2007
(Continued)

*Primary Examiner* — Carla J Therrien
(74) *Attorney, Agent, or Firm* — Jefferson IP Law, LLP

(57) ABSTRACT

An example shutter unit includes a motor including a driving shaft to rotate in a first rotation direction and to rotate in a second rotation direction opposed to the first rotation direction, a first shutter part to selectively expose a light window by receiving a driving force transferred from the driving shaft when the driving shaft rotates in the first rotation direction or the second rotation direction, and a second shutter part to selectively expose a sensor by receiving the driving force transferred from the driving shaft when the driving shaft rotates in the second rotation direction.

20 Claims, 18 Drawing Sheets

Related U.S. Application Data is a continuation of application No. 15/672,427, filed on Aug. 9, 2017, now Pat. No. 10,061,224.

(51) Int. Cl.
*G03G 15/04* (2006.01)
*G03G 15/16* (2006.01)
*G03G 21/16* (2006.01)

(52) U.S. Cl.
CPC ..... *G03G 15/5054* (2013.01); *G03G 15/5058* (2013.01); *G03G 21/1647* (2013.01); *G03G 21/1666* (2013.01); *G03G 2215/00059* (2013.01); *G03G 2215/0158* (2013.01); *G03G 2221/1636* (2013.01); *G03G 2221/1657* (2013.01)

(58) Field of Classification Search
CPC . G03G 2215/00059; G03G 2215/0158; G03G 15/04036; G03G 15/0435; G03G 2221/1636
See application file for complete search history.

(56) References Cited

U.S. PATENT DOCUMENTS

| | | | | |
|---|---|---|---|---|
| 8,035,669 | B2 | 10/2011 | Nakamura | |
| 8,909,089 | B2 | 12/2014 | Kim | |
| 9,122,226 | B2 | 9/2015 | Lee et al. | |
| 9,851,654 | B2 | 12/2017 | Bryant et al. | |
| 10,061,224 | B1 * | 8/2018 | Hwang | G03G 21/1647 |
| 2007/0070173 | A1 | 3/2007 | Yamakawa et al. | |
| 2009/0067862 | A1 * | 3/2009 | Nakamura | G03G 15/0435 399/51 |
| 2010/0316395 | A1 | 12/2010 | Hayashi | |
| 2013/0022378 | A1 * | 1/2013 | Kim | G03G 15/5054 399/301 |
| 2014/0294420 | A1 | 10/2014 | Lee | |
| 2015/0277320 | A1 | 10/2015 | Tani et al. | |
| 2016/0313685 | A1 * | 10/2016 | Yamana | G03G 15/5054 |
| 2017/0315467 | A1 * | 11/2017 | Bryant | B41J 2/44 |
| 2018/0210392 | A1 * | 7/2018 | Yamana | G03G 21/1676 |
| 2019/0107802 | A1 * | 4/2019 | Song | G03G 15/5054 |

FOREIGN PATENT DOCUMENTS

| | | | |
|---|---|---|---|
| JP | 2008015107 | A | 1/2008 |
| JP | 2010026157 | A | 2/2010 |
| JP | 2011008114 | A | 1/2011 |
| JP | 2011215561 | A | 10/2011 |
| JP | 2012189895 | A | 10/2012 |
| JP | 2012252156 | A | 12/2012 |
| KR | 10-2012-0088039 | A | 8/2012 |
| KR | 20160036919 | A | 4/2016 |
| WO | WO-2016/047881 | A1 | 3/2016 |

* cited by examiner

IMAGE FORMING APPARATUS AND METHOD FOR CONTROLLING THE SAME

BACKGROUND ART

An electrophotographic image forming apparatus, which a kind of image forming apparatus, irradiates light onto a rotating photoreceptor through an exposing unit to form an electrostatic latent image, supplies a toner to the photoreceptor on which the electrostatic latent image is formed to form a toner image on a surface of the photoreceptor, transfers the toner image of the photoreceptor to a transfer unit, again transfers the toner image to a printing medium, and presses and heats the image transferred to the printing medium through a fusing unit to form an image on the printing medium.

Since the exposing unit irradiates the light emitted from an internal light source to the photoreceptor through a light window, there is a risk that printing quality will be deteriorated due to pollution of the light window by the toner, dust, and the like.

Therefore, the image forming apparatus according to the related art may prevent the pollution of the light window by including a separate shutter unit closing the light window during a period in which the exposing unit is not operated and opening the light window when the exposing unit is operated.

In addition, the image forming apparatus according to the related art may form a color toner image on the printing medium, and generally overlaps toners of cyan (C), magenta (M), yellow (Y), and black (K) colors with one another to form the color toner image.

To this end, the image forming apparatus includes four developing units each including the toners of the cyan (C), magenta (M), yellow (Y), and black (K) colors, and overlaps the toners of the cyan (C), magenta (M), yellow (Y), and black (K) colors with one another through the developing units to transfer the color toner image to a transfer belt of the transfer unit and transfers the color toner image to the printing medium through the transfer belt to which the color toner image is transferred.

To form a high-quality color toner image, a precise control for overlapping toner images of the respective colors with one another at an accurate position is required. In the case in which color registrations of the color toner image output by the image forming apparatus according to the related art do not coincide with each other, the image forming apparatus according to the related art performs auto color registration (ACR) aligning the color toner image by forming predetermined measuring marks on the transfer belt of the transfer unit and then sensing the predetermined measuring marks through a separate sensor, to correct discrepancy between the color registrations.

The image forming apparatus according to the related art includes a separate shutter unit opening the sensor only during a period in which the ACR is performed to prevent the sensor from being polluted by the toner, dust, and the like, in the case in which it does not perform the ACR.

As described above, the image forming apparatus according to the related art separately includes the shutter unit for opening or closing the light window of the exposing unit and the shutter unit for opening or closing the sensor for performing the ACR, and drivers for driving the shutter unit for opening or closing the light window and the shutter unit for opening or closing the sensor are also separately configured, such that an entire structure of the image forming apparatus including the shutter units and a method for controlling the image forming apparatus become complicated.

DESCRIPTION OF DRAWINGS

Certain examples of the present disclosure will be more apparent from the following description taken in conjunction with the accompanying drawings, in which.

DETAILED DESCRIPTION

Figure 1:
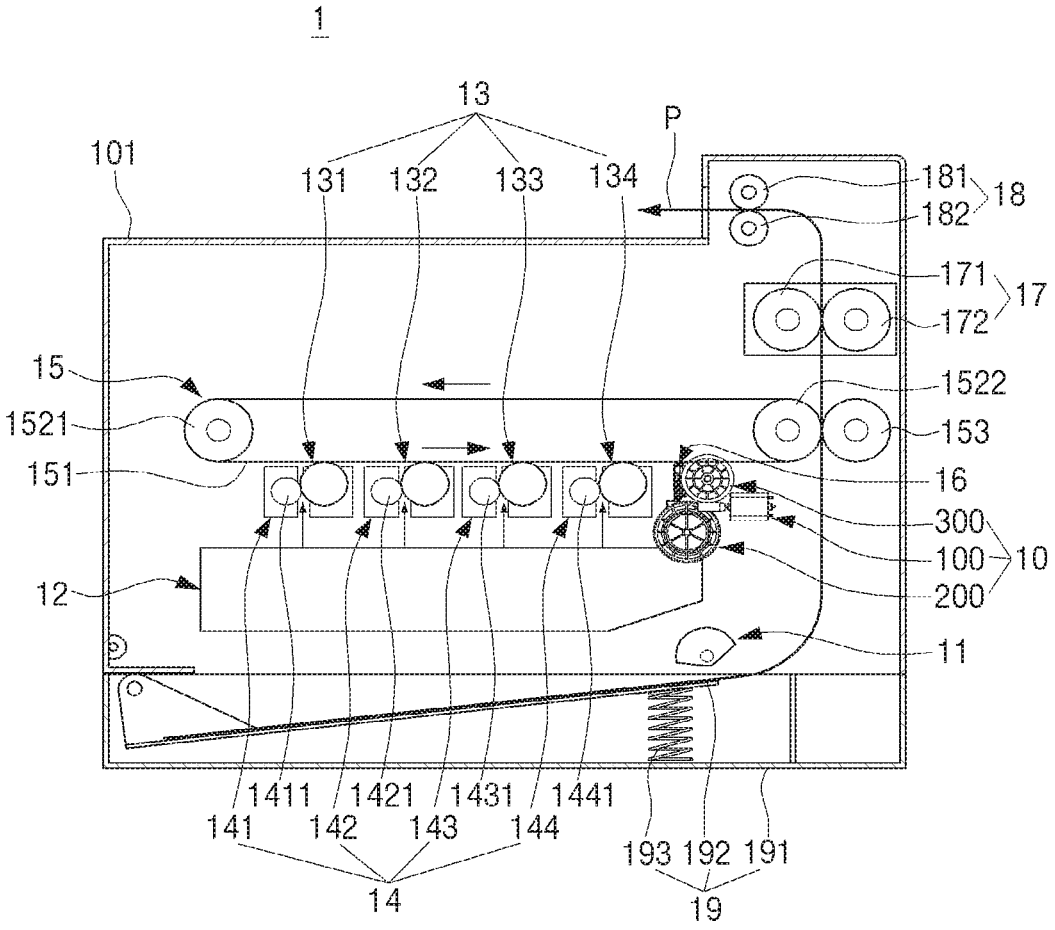
FIG. 1 is a view schematically illustrating a structure of an image forming apparatus according to an example.

Various examples will be described more fully hereinafter with reference to the accompanying drawings. The examples described hereinafter may be modified in many different forms.

The following examples may be variously modified without departing from the technical scope of the present disclosure, and these modifications are considered to fall within the technical scope of the present disclosure. In addition, to assist in the understanding of examples to be described below, components performing the same operations and related components in the respective examples will be denoted by the same or similar reference numerals throughout the accompanying drawings. Further, the accompanying drawings are not illustrated to scale, but sizes of some of components may be exaggerated to assist in the understanding of the present disclosure.

FIG. 1 is a view schematically illustrating a structure of an image forming apparatus according to an example.

Referring to FIG. 1, an image forming apparatus 1 may be implemented as a printer, a copier, a scanner, a facsimile, and the like, and may be a multi-function peripheral (MFP) in which functions of the printer, the copier, the scanner, and the facsimile, are complexly implemented through one apparatus.

As illustrated in FIG. 1, the image forming apparatus 1 may include a body 101, a paper feeding unit 11, an exposing unit 12, a photoreceptor 13, a developing unit 14, a transfer unit 15, a sensing unit 16, a fusing unit 17, a paper discharging unit 18, and a cassette unit 19 disposed in the body 101. In various examples, there may one or a plurality (e.g., four) of each of photoreceptors 13 and developing units 14 depending on a number of colors of toners used by the image forming apparatus 1.

The paper feeding unit 11 may pick up printing media such as paper, or the like, on which an image is to be formed, loaded in the cassette unit 19 one by one, and inject the picked-up printing media into a transport path P. The paper feeding unit 11 may include a pick-up roller to pick up the paper one by one and a plurality of transport rollers disposed on the transport path P.

The cassette unit 19 may include a cassette body 191 separably coupled to a lower portion of the body 101, a pick-up plate 192 on which the printing media are loaded, and a pick-up elastic member 193 elastically supporting the pick-up plate 192. A plurality of printing media loaded in the cassette body 191 may be picked up one by one by the pick-up roller of the paper feeding unit 11 in a state in which they are supported by the pick-up plate 192.

Although a case in which a single cassette unit 19 is separably coupled to the lower portion of the body 101 is illustrated by way of example in FIG. 1, the number of cassette units 19 may be plural, and the image forming apparatus 1 may further include a multipurpose tray coupled to a side surface or an upper portion of the body 101 and supplying the printing media into the body 101.

The exposing unit 12 irradiates light including image information to the photoreceptor 13 to form an electrostatic latent image on a surface of the photoreceptor 13, and the developing unit 14 supplies toners to the photoreceptor 13 on which the electrostatic latent image is formed to form toner images.

As an example, the developing unit 14 may include first to fourth developing units 141, 142, 143, and 144, and the first to fourth developing units 141 to 144 may include toners of cyan (C), magenta (M), yellow (Y), and black (K) colors, respectively.

The photoreceptor 13 may be implemented in a photoreceptor drum form. The photoreceptor 13 may include first to fourth photoreceptors 131, 132, 133, and 134 respectively corresponding to the first to fourth developing units 141 and 144. In addition, first to fourth charging rollers (not illustrated) respectively charging the first to fourth photoreceptors 131 to 134 may be disposed on outer peripheral surfaces of the first to fourth photoreceptors 131 to 134. The first to fourth charging rollers may uniformly charge surfaces of the first to fourth photoreceptors 131 to 134 that rotate at a predetermined potential, respectively.

As illustrated in FIG. 1, the exposing unit 12 is disposed below the first to fourth photoreceptors 131 to 134 and irradiates the light including the image information to the charged first to fourth photoreceptors 131 to 134 to form electrostatic latent images on the outer peripheral surfaces of the first to fourth photoreceptors 131 to 134. The exposing unit 12 may irradiate light including image information for each color of each toner to the first to fourth photoreceptors 131 to 134.

The first to fourth developing units 141 to 144 may include first to fourth developing rollers 1411, 1421, 1431, and 1441 facing the first to fourth photoreceptors 131 to 134, respectively. The first to fourth developing rollers 1411 to 1441 may selectively be in contact with the first to fourth photoreceptors 131 to 134 on which the electrostatic latent images are formed, respectively, and rotate in a state in which they are in contact with the first to fourth photoreceptors 131 to 134, respectively, to move the toners of the cyan (C), magenta (M), yellow (Y), and black (K) colors to the electrostatic latent images formed on the first to fourth photoreceptors 131 to 134.

Therefore, visible toner images of the cyan (C), magenta (M), yellow (Y), and black (K) colors are formed on the surfaces of the first to fourth photoreceptors 131 to 134.

The transfer unit 15 may include a transfer belt 151, rotation rollers 1521 and 1522 to rotate the transfer belt 151, and a transfer roller 153 facing the transfer belt 151 to form a nib through which the printing medium passes.

The rotation rollers 1521 and 1522 may rotatably support the transfer belt 151, and the transfer belt 151 may rotate depending on rotation of the first and second rotation rollers 1521 and 1522. For example, the first rotation roller 1521 may maintain tension of the transfer belt 151, and the second rotation roller 1522 may rotate through a separate driver to rotate the transfer belt 151. However, the rotation rollers 1521 and 1522 may further include a plurality of rotation rollers, in addition to the first and second rotation rollers 1521 and 1522.

The transfer belt 151 may rotate in a state in which it is in contact with the first to fourth photoreceptors 131 to 134, and the toner images of the first to fourth photoreceptors 131 to 134 may be sequentially transferred to the transfer belt 151.

As an example, as illustrated in FIG. 1, as the transfer belt 151 rotates in a counterclockwise direction in FIG. 1, the toner images of the cyan (C), magenta (M), yellow (Y), and black (K) colors of the first to fourth photoreceptors 131 to 134 may be sequentially transferred to the transfer belt 151. Therefore, a color toner image in which the toner images of the cyan (C), magenta (M), yellow (Y), and black (K) colors are overlapped with one another may be formed on the transfer belt 151.

The color toner image formed on the transfer belt 151 may be transferred to the printing medium passing between the transfer belt 151 and the transfer roller 153.

Figure 9:
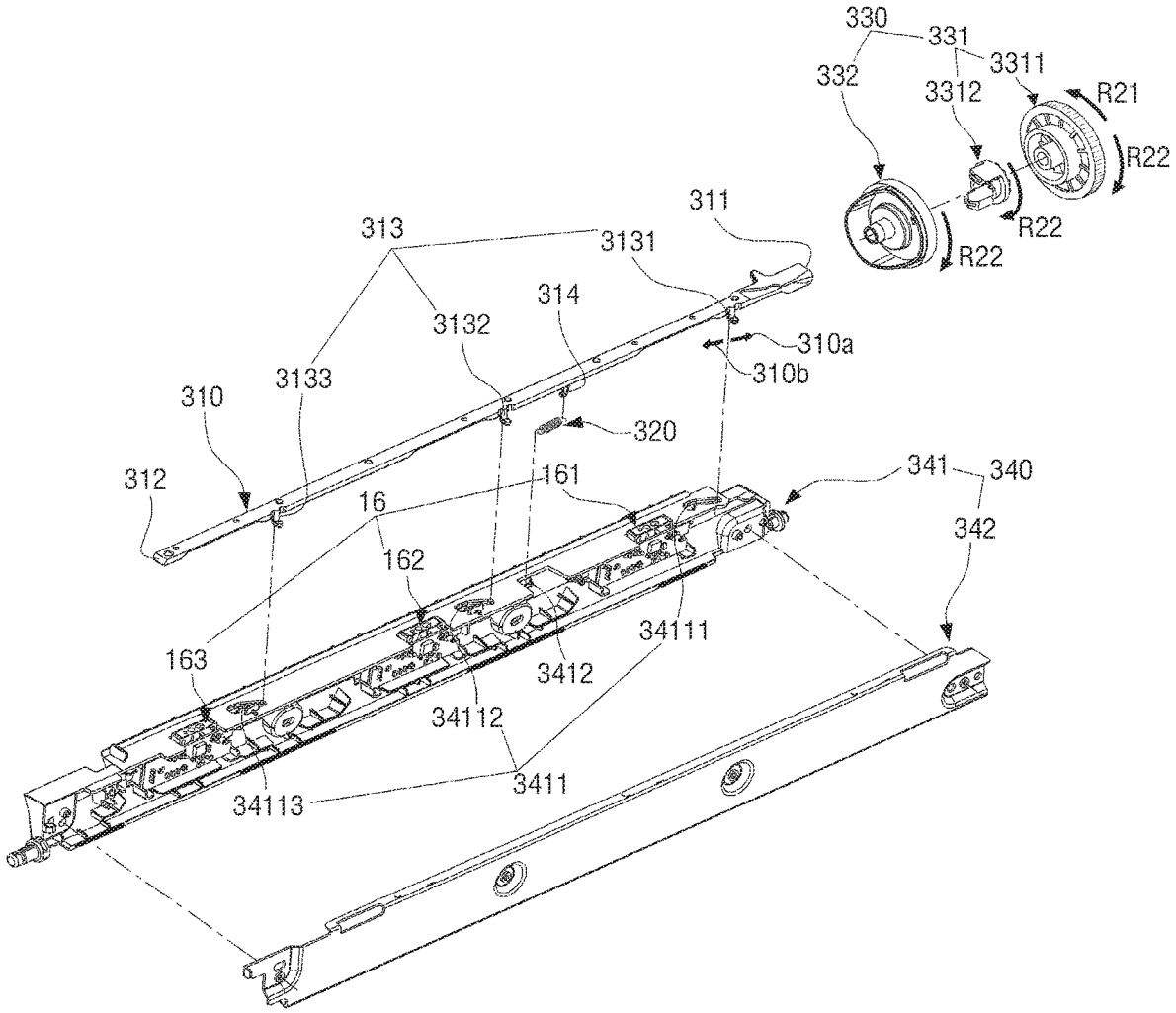
FIG. 9 is an exploded perspective view of the sensing unit and the second shutter part illustrated in FIG. 8 according to an example.

The sensing unit 16 may face the transfer belt 151 to sense the color toner image transferred to the transfer belt 151 and include one or more sensors (e.g., 161, 162, and 163 as illustrated in FIG. 9). The sensors 161 to 163 configuring the sensing unit 16 may be image sensors such as an optical sensor, a complementary metal oxide semiconductor (CMOS) sensor, a charge coupled device (CCD) sensor, and the like.

In an example, the sensing unit 16 may be disposed between the first to fourth photoreceptors 131 to 134 and the transfer roller 153, and as illustrated in FIG. 1, the sensing unit 16 may be disposed adjacently to the transfer belt 151, and be disposed behind the fourth photoreceptor 134 in a rotation direction of the transfer belt 151.

In a case in which the developing unit 14 is replaced, the image forming apparatus 1 performs a large amount of printing, the image forming apparatus is not operated for a long period of time, or the like, color registrations of the color toner image output by the image forming apparatus 1 may not coincide with each other. In this case, toners of the respective colors may not accurately overlap with one another such that quality deterioration (e.g., a boundary portion of the color toner image looks blurred, etc.) may occur.

To address such a problem, the image forming apparatus 1 may be operated in an auto color registration (ACR) mode for performing ACR.

As an example, predetermined measuring marks may be formed on the transfer belt 151 through the first to fourth photoreceptors 131 to 134 and the first to fourth developing units 141 to 144 and be sensed through the sensing unit 16.

The measuring marks may include a plurality of measuring marks at which the toner images of the cyan (C), magenta (M), yellow (Y), and black (K) colors are marked to be independent from or overlapped with one another depending on predetermined widths and lengths. A controller (not illustrated) may sense widths, lengths, and the like, of the plurality of measuring marks through the sensing unit 16 to determine whether or not the measuring marks formed on the transfer belt 151 coincide with a reference. In a case in which the measuring marks formed on the transfer belt 151 correspond to a predetermined ACR correction condition, the controller may control the exposing unit 12, the photoreceptor 13, the developing unit 14, or the transfer unit 15 to perform correction on the color toner image formed on the transfer belt 151 and the printing medium.

However, since a process of performing the ACR through the sensing unit 16 described above is similar to that of the related art, an overlapped description will be omitted.

The fusing unit 17 may include first and second fusing rollers 171 and 172. In an example, the printing medium to which the color toner image is transferred is pressed and heated during a period in which it passes between the first and second fusing rollers 171 and 172 that rotate, such that the color toner image may be fused on the printing medium.

The paper discharging unit 18 may include first and second paper discharging rollers 181 and 182. In an example, the printing medium on which the color toner image is fused by the fusing unit 17 may pass between the first and second paper discharging rollers 181 and 182 that rotate and be discharged to the outside of the image forming apparatus 1.

Figure 5:
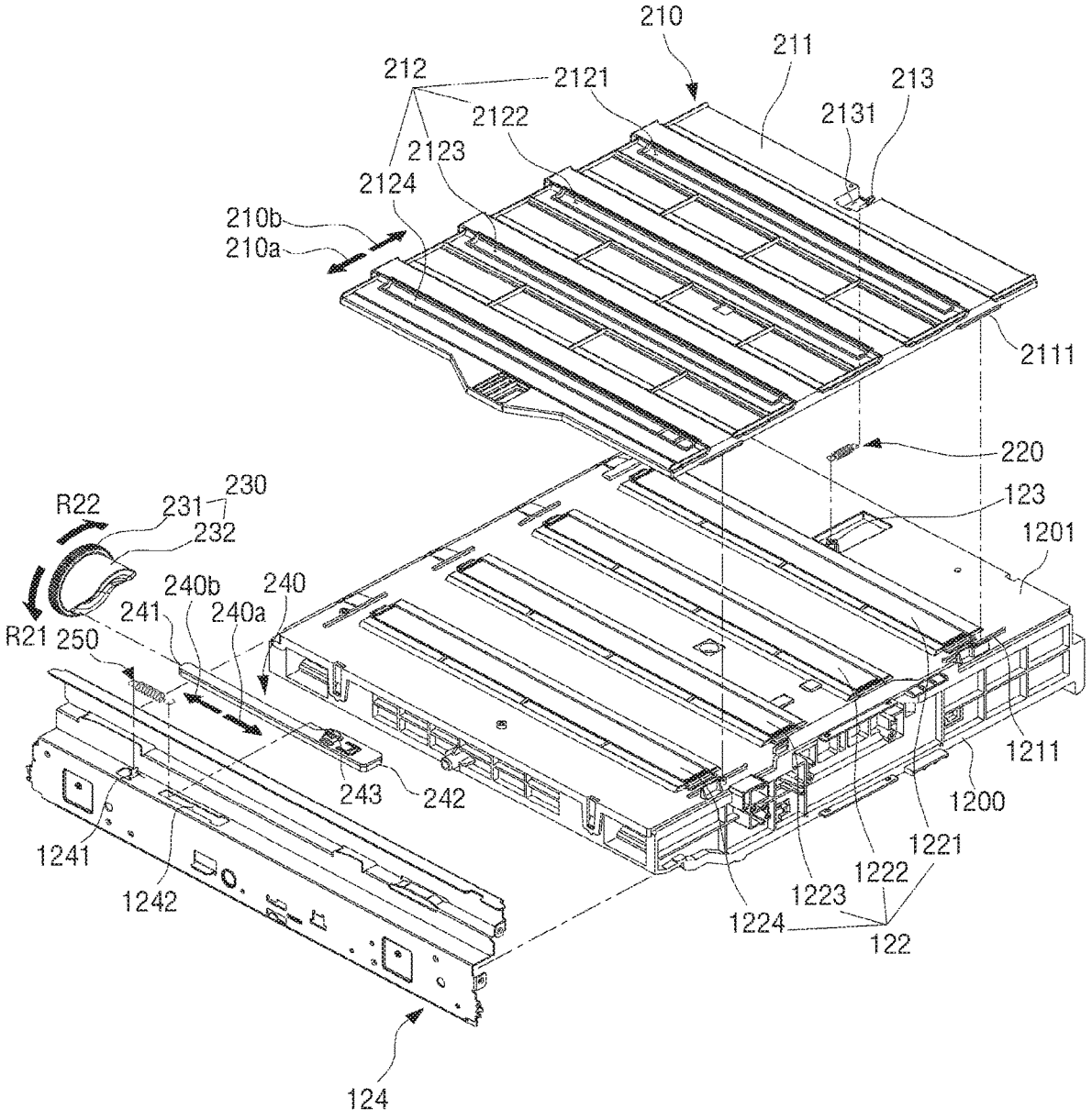
FIG. 5 is an exploded perspective view of the exposing unit and the first shutter part illustrated in FIG. 4 according to an example.

The image forming apparatus 1 may include a shutter unit 10 to selectively expose (i.e., open or close) a light window (e.g., 122 as illustrated in FIG. 5) of the exposing unit 12 and the sensors 161 to 163 of the sensing unit 16.

The shutter unit 10 may include a motor 100, a first shutter part 200, and a second shutter part 300. In an example, the first and second shutter parts 200 and 300 may receive a driving force transferred from the motor 100 to selectively expose (i.e., open or close) the light window 122 and the sensors 161 to 163, thereby reducing or preventing the window 122 and the sensors 161 to 163 from being polluted by pollutants such as the toners, dust, and the like.

Example structures of the exposing unit 12, the sensing unit 16, and the shutter unit 10 will be described below.

Figure 2:
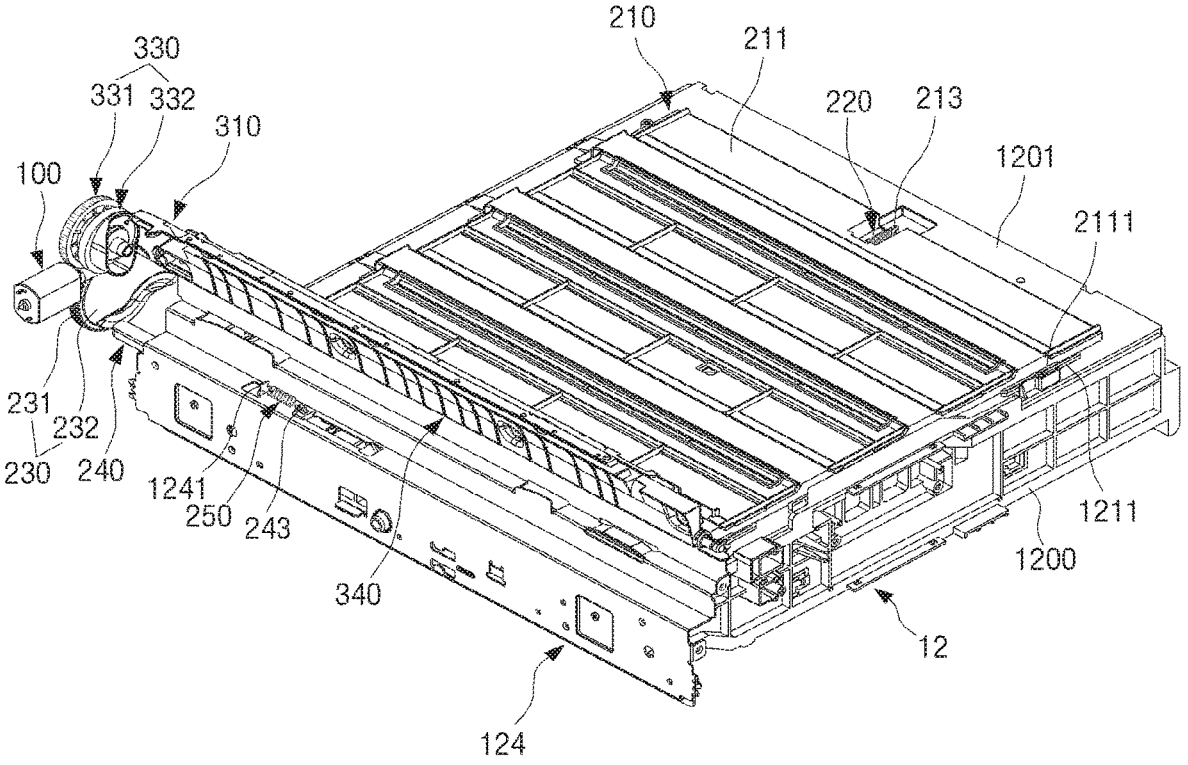
FIG. 2 is a perspective view illustrating an exposing unit, a sensing unit, and a shutter unit according to an example.

FIG. 2 is a perspective view illustrating an exposing unit, a sensing unit, and a shutter unit according to an example.

Referring to FIG. 2, a state in which the shutter unit 10 closes the light window 122 (see FIG. 5) of the exposing unit 12 and the sensors 161 to 163 (see FIG. 9) is illustrated.

The exposing unit 12 includes a light source (not illustrated) disposed in an exposing unit body 1200 and the light window 122 transmitting light emitted from the light source to the photoreceptor 13.

The exposing unit 12 is disposed below the first to fourth photoreceptors 131 to 134 and may irradiate light including image information depending on the respective toner colors to the first to fourth photoreceptors 131 to 134.

First to fourth light windows (e.g., 1221, 1222, 1223, and 1224 as illustrated in FIG. 5) facing the first to fourth photoreceptors 131 and 134, respectively, are disposed on an upper surface 1201 of the exposing unit body 1200.

The exposing unit 12 may irradiate the light including the image information to the first to fourth photoreceptors 131 to 134 through the first to fourth light windows 1221 to 1224, respectively, to form the electrostatic latent images on the first to fourth photoreceptors 131 to 134.

The first shutter part 200 opening or closing the first to fourth light windows 1221 to 1224 may be disposed on the exposing unit 12.

The first shutter part 200 may include a first cover 210, a first elastic member 220, a first cam gear 230, a first lever 240, and a lever elastic member 250.

The first cover 210 is disposed on the upper surface 1201 of the exposing unit body 1200 of the exposing unit 12 and may reciprocate to selectively open or close the first to fourth light windows 1221 to 1224. The first elastic member 220 may connect the first cover 210 and the upper surface 1201 of the exposing unit body 1200 of the exposing unit 12 to each other to apply an elastic force to the first cover 210. The first cam gear 230 may rotate by receiving a driving force transferred from the motor 100 to selectively push the first lever 240, and the first lever 240 may push the first cover 210 to move the first cover 210 in a direction in which the first cover 210 opens the first to fourth light windows 1221 to 1224. In addition, movement of the first lever 240 may be guided by a guide member 124 covering one side of the exposing unit 12.

The second shutter part 300 may include a second cover 310, a second elastic member (e.g., 320 as illustrated in FIG. 9), a second cam gear 330, and a second shutter part body 340.

The sensing unit 16 may be disposed in the second shutter part body 340 to face the transfer belt 151 disposed above, and the second cover 310 may cover an upper surface of the second shutter part body 340 to close the sensing unit 16. The second cam gear 330 may rotate by receiving a driving force transferred from the motor 100 to selectively push the second cover 310, such that the second cover 310 may selectively open or close the sensing unit 16.

Example structures of the first and second shutter parts 200 and 300 will be described below.

As illustrated in FIG. 2, the first cam gear 230 of the first shutter part 200 and the second cam gear 330 of the second shutter part 300 may simultaneously receive the driving force transferred from the motor 100, such that the first shutter part 200 and the second shutter part 300 may be simultaneously operated.

Figure 3:
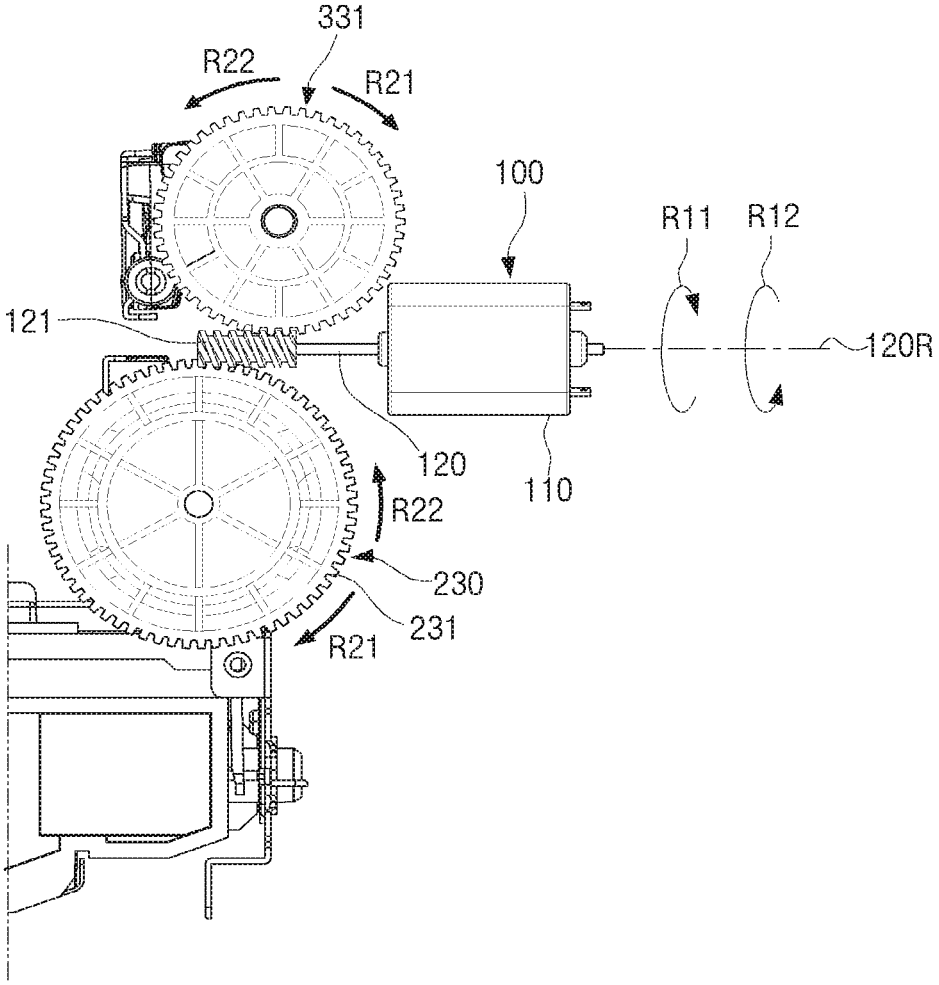
FIG. 3 is a side view of a motor, a first shutter part, and a second shutter part according to an example.

FIG. 3 is a side view of a motor, a first shutter part, and a second shutter part according to an example.

Referring to FIG. 3, a structure in which a driving force is transferred from the motor 100 to the first and second shutter parts 200 and 300 will be described.

As described above, the first and second shutter parts 200 and 300 may be operated by simultaneously by receiving a driving force transferred from a single motor 100.

As an example, the motor 100 may include a motor body 110 and a driving shaft 120 coupled to the motor body 110 to rotate in a first rotation direction R11 or a second rotation direction R12.

As illustrated in FIGS. 2 and 3, the first cam gear 230 may be disposed below the motor 100 and be engaged to rotate with the driving shaft 120. The second cam gear 330 may be disposed above the motor 100 and be engaged to rotate with the driving shaft 120.

The first cam gear 230 may include a first gear part 231 that may engage and rotate with the driving shaft 120. The first gear part 231 may rotate depending on a rotation of the driving shaft 120 to rotate the first cam gear 230.

The second cam gear 330 may include a one-way clutch gear 331 that may engage and rotate with the driving shaft 120. The one-way clutch gear 331 may rotate depending on a rotation of the driving shaft 120 to rotate the second cam gear 330.

The driving shaft 120 may include a driving gear 121 that may couple to and rotate with a front end portion. The first gear part 231 and the one-way clutch gear 331 may be engaged to rotate with the driving gear 121.

As illustrated in FIG. 3, a rotation center 120R of the driving shaft 120 may be perpendicular to rotation directions of the first and second cam gears 230 and 330. In an example, the driving gear 121 may be a worm gear, and the first gear part 231 and the one-way clutch gear 331 engaged with the driving gear 121 may be spur gears. However, a gear structure illustrated in FIG. 3 is an example. In other examples, the rotation center of the driving shaft 120 and shafts of the first and second cam gears 230 and 330 may be parallel with each other, and structures of the first gear part 231 and the one-way clutch gear 331 simultaneously engaged and rotating with the driving shaft 120 may be variously modified.

In an example, rotation directions of the first gear part 231 and the one-way clutch gear 331, which rotate depending on the rotation of the driving shaft 120, are opposite to each other.

As an example, as illustrated in FIG. 3, when the driving shaft 120 rotates in the first rotation direction R11 around the rotation center 120R, the first gear part 231 rotates in a fourth rotation direction R22 (e.g., a counterclockwise direction in FIG. 3), and the one-way clutch gear 331 rotates in a third rotation direction R21 (e.g., a clockwise direction in FIG. 3) opposite to the fourth rotation direction R22.

In addition, when the driving shaft 120 rotates in the second rotation direction R12 opposite to the first rotation direction R11, the first gear part 231 rotates in the third rotation direction R21, and the one-way clutch gear 331 rotates in the fourth rotation direction R22.

The one-way clutch gear 331 may transfer the driving force to the second cam gear 330 only in a case in which it rotates in the fourth rotation direction R22, and block the driving force transferred to the second cam gear 330 in a case in which it rotates in the third rotation direction R21. Therefore, in a case in which the driving shaft 120 rotates in the first rotation direction R11, the first shutter part 200 may be operated, and the second shutter part 300 may be in a stand-by state in which it is not operated.

A rotation direction of the driving shaft 120 may be changed to either one of the first and second rotation directions R11 and R12, such that only the first shutter part 200 may be independently driven or the first and second shutter parts 200 and 300 may be simultaneously driven. An example structure of the second cam gear 330 including the one-way clutch gear 331 and an example method for controlling the first and second shutter parts 200 and 300 will be described below.

Figure 4:
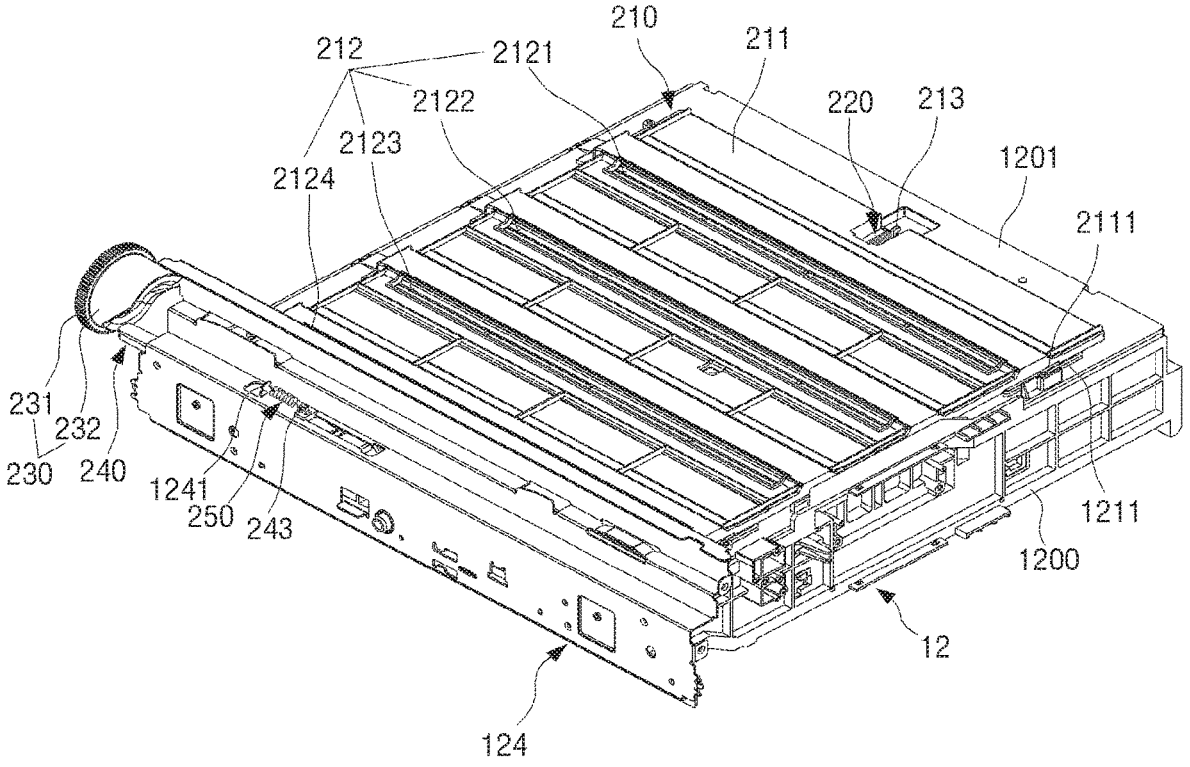
FIG. 4 is a perspective view illustrating the exposing unit and the first shutter part illustrated in FIG. 2 according to an example.
Figure 6:
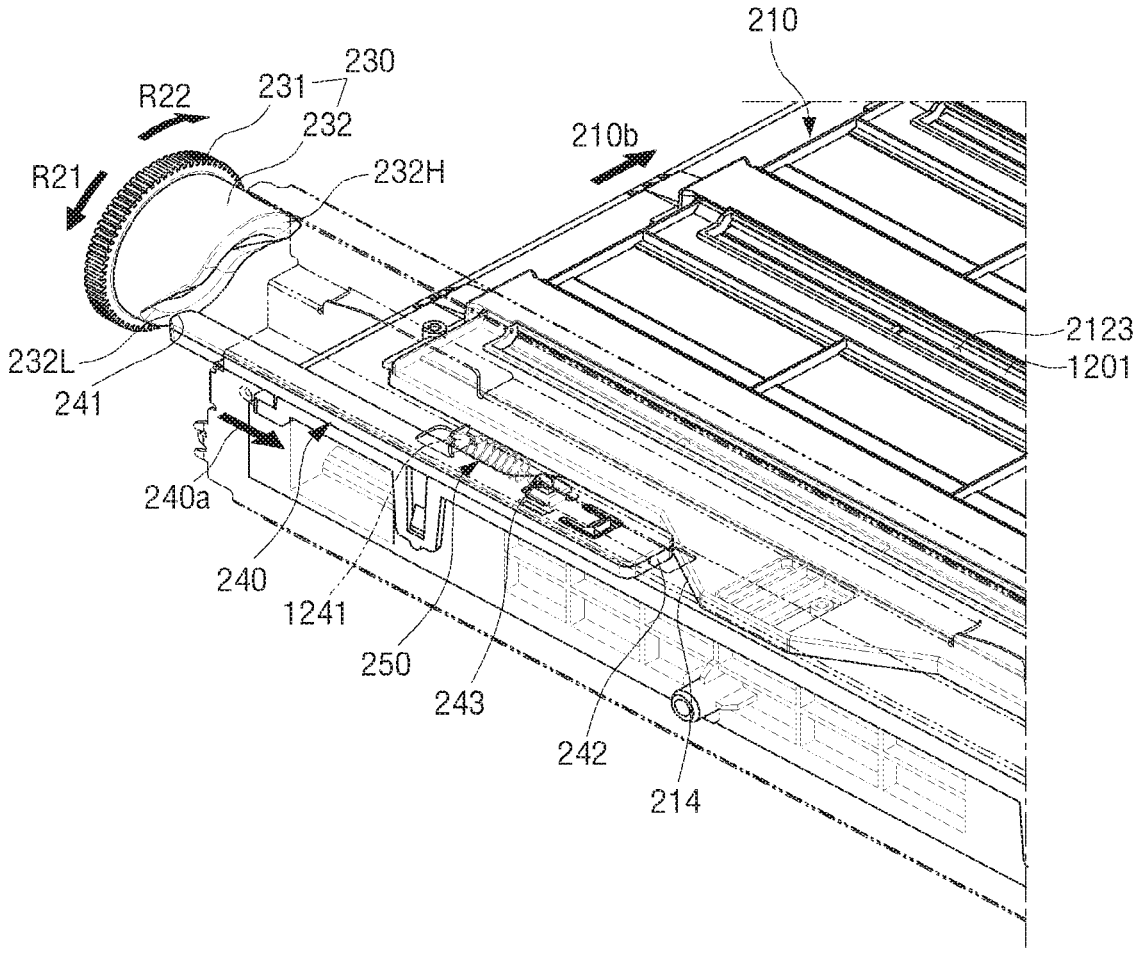
FIG. 6 is a view illustrating a state in which the first shutter part illustrated in FIG. 4 closes a light window according to an example.
Figure 7:
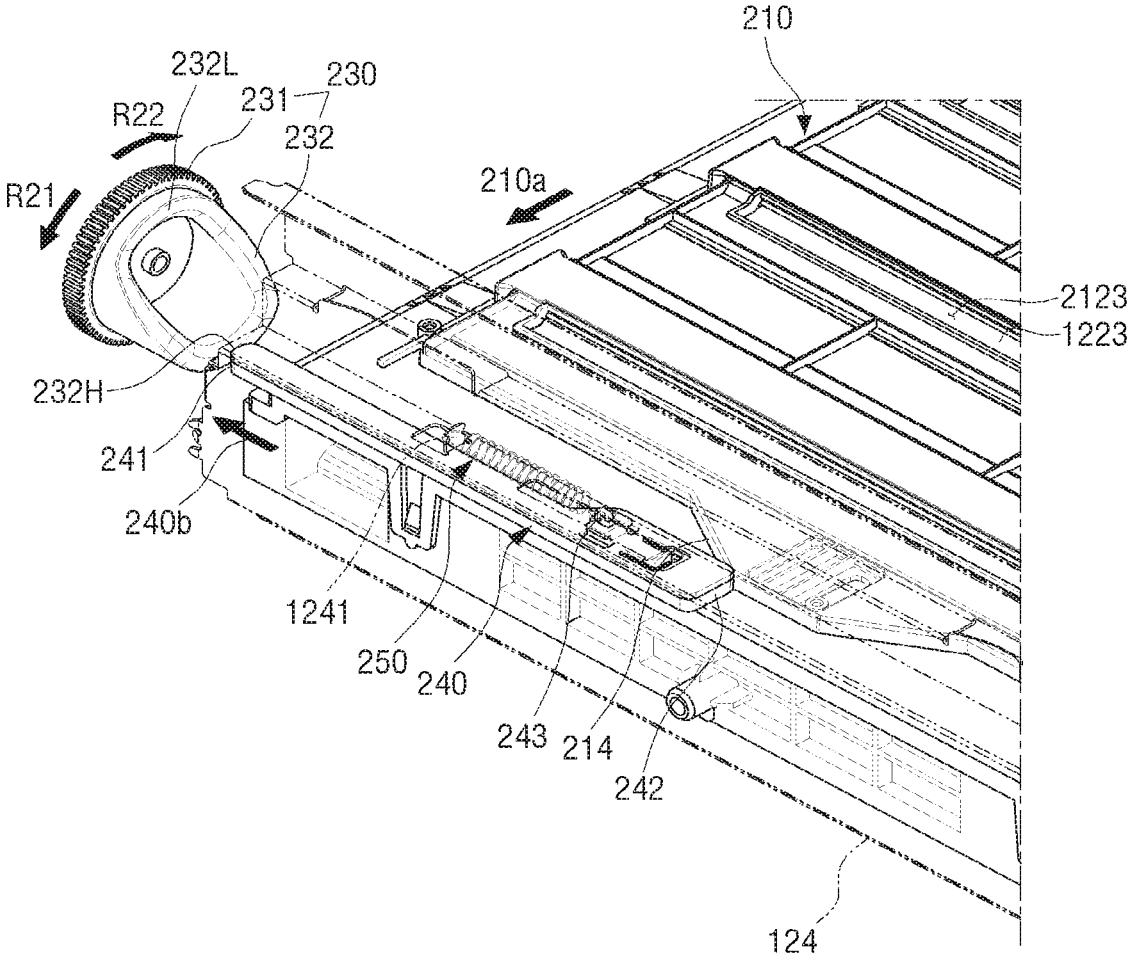
FIG. 7 is a view illustrating a state in which the first shutter part illustrated in FIG. 4 opens the light window according to an example.

FIG. 4 is a perspective view illustrating the exposing unit 12 and the first shutter part 200 illustrated in FIG. 2 according to an example, and FIG. 5 is an exploded perspective view of the exposing unit 12 and the first shutter part 200 illustrated in FIG. 4 according to an example. FIG. 6 is a view illustrating a state in which the first shutter part 200 illustrated in FIG. 4 closes a light window 122 according to an example, and FIG. 7 is a view illustrating a state in which the first shutter part 200 illustrated in FIG. 4 opens the light window 122 according to an example.

Hereinafter, an example of the first shutter part 200 opening or closing the light window 122 of the exposing unit 12 will be described with reference to FIGS. 4 to 7.

As described above, the exposing unit 12 may include the exposing unit body 1200, the light source (not illustrated) provided in the exposing unit body 1200, and the first to fourth light windows 1221 to 1224 disposed on the upper surface 1201 of the exposing unit body 1200.

The first to fourth light windows 1221 to 1224 may transmit the light emitted from the light source to the first to fourth photoreceptors 131 to 134, and the exposing unit 12 may irradiate the light including the image information corresponding to the toner images of the cyan (C), magenta (M), yellow (Y), and black (B) colors to the first to fourth photoreceptors 131 to 134 through the first to fourth light windows 1221 to 1224, respectively.

As the exposing unit 12, a laser scanning unit (LSU) or a light emitting diode (LED) print head (LPH) may be used. The laser scanning unit may include a light source emitting light and a reflecting mirror that is rotatable, and reflect the light irradiated from the light source on the reflecting mirror that rotates, transmit the light through a light window, and irradiate the light to a photoreceptor. The LED print head may include an LED array to directly irradiate linear light to a photoreceptor.

As described above, the first shutter part 200 may include the first cover 210, the first elastic member 220, the first cam gear 230, the first lever 240, and the lever elastic member 250.

The first cover 210 is movably disposed on the exposing unit 12, that is, on the first to fourth light windows 1221 to 1224 to selectively expose (i.e., open or close) the first to fourth light windows 1221 to 1224.

The first cover 210 may include a first plate 211 having a quadrangular shape corresponding to a shape of the upper surface 1201 of the exposing unit body 1200, and first to fourth openings 212 (i.e., 2121, 2122, 2123, and 2124) formed in the first plate 211 and corresponding, respectively, to the first to fourth light windows 1221 to 1224.

The first cover 210 may reciprocate in a first close direction 210*a* in which it closes (i.e., covers) the first to fourth light windows 1221 to 1224 and a first open direction 210*b* in which it opens (i.e., exposes) the first to fourth light windows 1221 to 1224, on the upper surface 1201 of the exposing unit body 1200.

When the first cover 210 moves in the first close direction 210*a*, the first to fourth openings 2121 to 2124 of the first cover 210 and the first to fourth light windows 1221 to 1224 are disposed to be misaligned with each other, as illustrated in FIG. 6. Therefore, the first to fourth light windows 1221 and 1224 are covered and closed by the first cover 210.

When the first cover 210 moves in the first open direction 210*b*, the first to fourth openings 2121 to 2124 of the first cover 210 and the first to fourth light windows 1221 to 1224 face each other, as illustrated in FIG. 7. Therefore, the first to fourth light windows 1221 to 1224 are opened through the first to fourth openings 2121 to 2124.

The first cover 210 may include at least one sliding protrusion 2111 extended in a direction parallel with a moving direction. A sliding groove 1211 corresponding to the sliding protrusion 2111 may be provided in the upper surface 1201 of the exposing unit body 1200.

The sliding protrusion 2111 of the first cover 210 may be slidably inserted into the sliding groove 1211. Therefore, the first cover 210 may be reciprocated between the first close direction 210*a* and the first open direction 210*b*.

The structures of the sliding protrusion 2111 of the first cover 210 and the sliding groove 1211 of the exposing unit 12 described above may be replaced by each other, and may be replaced by various structures that may guide the reciprocation of the first cover 210.

The first elastic member 220 may apply an elastic force to the first cover 210 so that the first cover 210 moves in the first close direction 210*a*.

As an example, one end of the first elastic member 220 may be connected to a hooked part 213 formed at one side of the first cover 210, and the other end of the first elastic member 220 may be connected to a hooked part 123 formed on the upper surface 1201 of the exposing unit body 1200. Therefore, the first elastic member 220 may pull the first cover 210 in the first close direction 210*a*. Accordingly, the first elastic member 220 may be a tension spring. In this case, the hooked part 123 of the exposing unit 12 may be disposed toward the first close direction 210*a* as compared with the hooked part 213 of the first cover 210.

In addition, the first plate 211 may include a hole 2131 into which the hooked part 123 of the exposing unit 12 may be inserted. The first elastic member 220 may apply the elastic force to the hooked part 213 of the first cover 210 in the hole 2131 of the first plate 211.

Therefore, the first elastic member 220 may apply the elastic force to the first cover 210 in the first close direction 210*a* opposed to the first open direction 210*b* so that the first cover 210 maintains a state in which it closes the first to fourth light windows 1221 to 1224.

The first cam gear 230 may include the first gear part 231 engaged with and rotating the driving shaft 120 and a first cam 232 coupled to the first gear part 231.

As described above, the first cam gear 230 may rotate in the third rotation direction R21 and the fourth rotation direction R22 opposed to the third rotation direction R21 through the first gear part 231 engaged with the driving shaft 120. The first cam 232 may also rotate in the third and fourth rotation directions R21 and R22. The first gear part 231 and the first cam 232 may be formed integrally with each other.

As illustrated in FIGS. 4 to 7, the first cam 232, which may be an edge cam protruding in a direction parallel with a shaft, may rotate using a cross section of a cylinder cut in an oblique direction as a contour curved line. In addition, the first cam 232 may be a disk cam. Since the edge cam and the disk cam that may be used as the first cam 232 are similar to those according to the related art, a detailed description therefor will be omitted.

The first lever 240 may reciprocate in a length direction in a state in which one end 241 thereof is in contact with the first cam 232 and another end 242 thereof is in contact with the first cover 210.

The first lever 240 may have a shape of a bar extended in a direction parallel with a shaft of the first cam gear 230. The first lever 240 may reciprocate depending on the rotation of the first cam 232 on the upper surface 1201 of the exposing unit body 1200 to push the first cover 210 in the first open direction 210*b*.

As an example, the first lever 240 may reciprocate in a direction perpendicular to a moving direction of the first cover 210, and may reciprocate in a first direction 240*a* in which it pushes the first cover 210 in the first open direction 210*b* and a second direction 240*b* opposed to the first direction 240*a*.

The first lever 240 may be disposed so that one end 241 thereof is in contact with the first cam 232 on one end portion of the upper surface 1201 of the exposing unit body 1200, and may be slid along an inner side surface of the guide member 124 covering one side of the exposing unit body 1200, such that the reciprocation of the first lever 240 in the first and second directions 240*a* and 240*b* may be guided.

The lever elastic member 250 may apply an elastic force to the first lever 240 so that the first lever 240 moves in the second direction 240*b*. The lever elastic member 250 may have one end connected to a hooked part 1241 of the guide member 124 and another end connected to a hooked part 243 of the first lever 240 to pull the first lever 240 in the second direction 240*b*. In an example, the lever elastic member 250 may be a tension spring. In this case, the hooked part 1241 of the guide member 124 may be disposed toward the second direction 240*b* as compared with the hooked part 243 of the first lever 240.

The guide member 124 may include a hole 1242 in which the hooked part 243 of the first lever 240 may be inserted and move. The lever elastic member 250 may apply the elastic force between the hooked part 243 of the first lever 240 and the hooked part 1241 of the guide member 124.

One end 241 of the first lever 240 may press the first cam 232 in the second direction 240*b* in a state in which it is in contact with the first cam 232 by the elastic force of the lever elastic member 250.

The first cover 210 may include an inclined part 214. In an example, the inclined part 214 may be formed by protruding a portion of one end portion of the first cover 210 adjacent to the first lever 240 in the first close direction 210*a*. The first lever 240 may reciprocate in the first and second directions 240*a* and 240*b* in a state in which the other end 242 thereof is in contact with the inclined part 214. When the first lever 240 moves in the first direction 240*a*, the other end 242 of the first lever 240 may push the inclined part 214 to move the first cover 210 in the first open direction 210*b*.

In addition, the first cam 232 may include a first portion 232L having the lowest phase and a second portion 232H having the highest phase on the basis of the first direction 240*a*.

The first portion 232L and the second portion 232H correspond to portions of the contour curved line of the first cam 232 in contact with one end 241 of the first lever 240. The first portion 232L and the second portion 232H are disposed at an interval of 180° on the basis of a rotation center of the first cam 232.

One end 241 of the first lever 240 in contact with the first cam 232 may be in alternate contact with the first portion 232L and the second portion 232H depending on the rotation of the first cam 232. When the first cam 232 rotates by 180° in the third rotation direction R21 or the fourth rotation direction R22 in a state in which one end 241 of the first lever 240 is in contact with the first portion 232L, one end 241 of the first lever 240 is in contact with the second portion 232H.

As an example, as illustrated in FIG. 6, when one end 241 of the first lever 240 is in contact with the first portion 232L, the first lever 240 moves in the second direction 240*b* by the elastic force of the lever elastic member 250. Therefore, the first cover 210 moves in the first close direction 210*a* to close the first to fourth light windows 1221 to 1224.

When the first cam 232 starts to rotate in the third rotation direction R21 or the fourth rotation direction R22 in the state in which one end 241 of the first lever 240 is in contact with the first portion 232L, the first cam 232 presses one end 241 of the first lever 240 in the first direction 240*a* to push the first lever 240 in the first direction 240*a*. Therefore, the other end 242 of the first lever 240 presses the inclined part 214, such that the first cover 210 is pushed in the first open direction 210*b*.

As illustrated in FIG. 7, when the first cam 232 rotates by 180° in the state in which one end 241 of the first lever 240 is in contact with the first portion 232L, one end 241 of the first lever 240 is in contact with the second portion 232H to push the first cover 210 in the first open direction 210*b*. Therefore, the first cover 210 may open the first to fourth light windows 1221 to 1224.

In addition, when the first cam 232 again rotates by 180° in a state in which the first cover 210 is opened, the first cover 210 may close the first to fourth light windows 1221 to 1224, as illustrated in FIG. 6.

As described above, in a standby mode of the image forming apparatus 1, the first cover 210 maintains a state in which it closes the first to fourth light windows 1221 to 1224 by the elastic force of the first elastic member 220.

When a printing mode starts, the first cover 210 opens the first to fourth light windows 1221 to 1224 through the rotation of the first cam 232, and the exposing unit 12 may irradiate the light to the first to fourth photoreceptors 131 to 134 to form the electrostatic latent images. When the printing mode ends, the first cam 232 may again rotate to close the first to fourth light windows 1221 to 1224 through the first cover 210.

The first to fourth light windows 1221 to 1224 may be opened through the first cover 210 only at the time of an operation of the exposing unit 12 and may be closed through the first cover 210 in the standby mode, such that pollution of the first to fourth light windows 1221 to 1224 due to the toners, and the like, may be reduced or prevented.

In addition, although an example in which the first shutter part 200 has a structure in which the first lever 240 reciprocates in the first and second directions 240*a* and 240*b* through the rotation of the first cam gear 230 to push the first cover 210 in the first open direction 210*b* is illustrated by way of example in FIGS. 4 to 7, the first shutter part 200 may also have a structure in which the first cam 232 of the first cam gear 230 rotates to directly push the first cover 210 in the first open direction 210*b*, without separately using the first lever 240.

Figure 8:
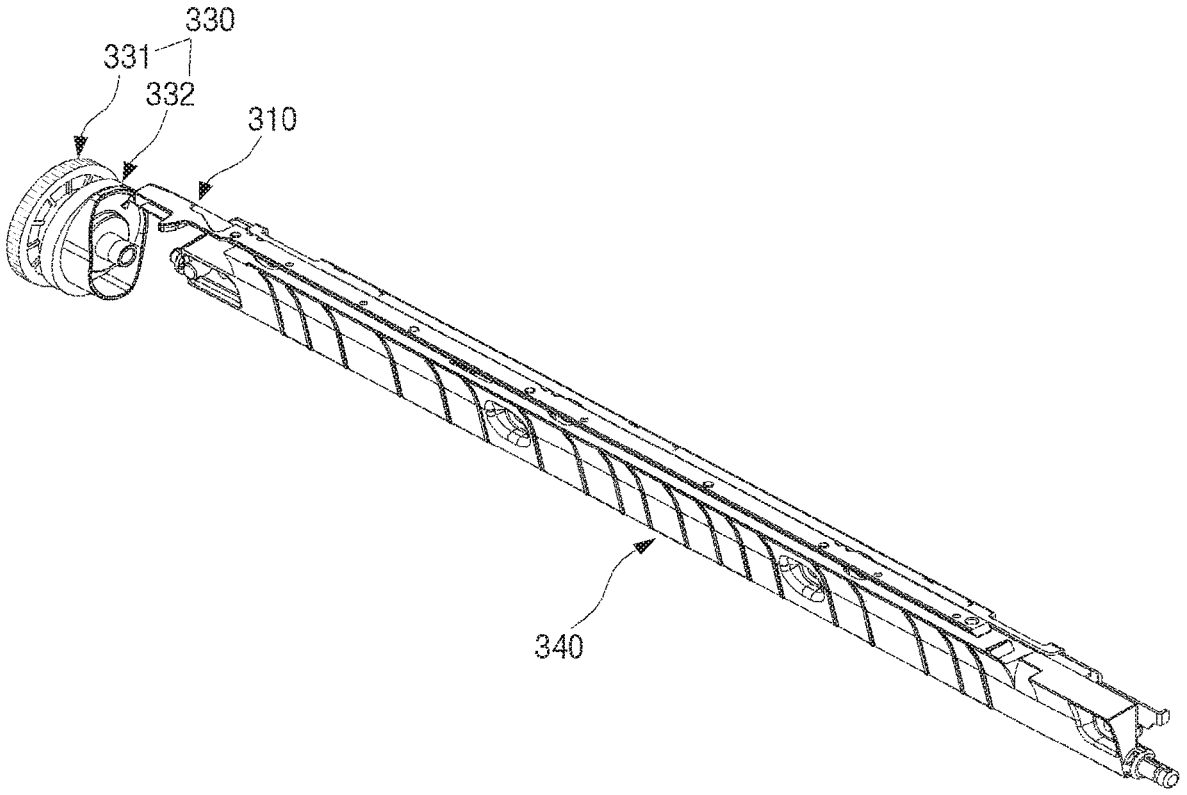
FIG. 8 is a perspective view illustrating the sensing unit and the second shutter part illustrated in FIG. 2 according to an example.
Figure 10:
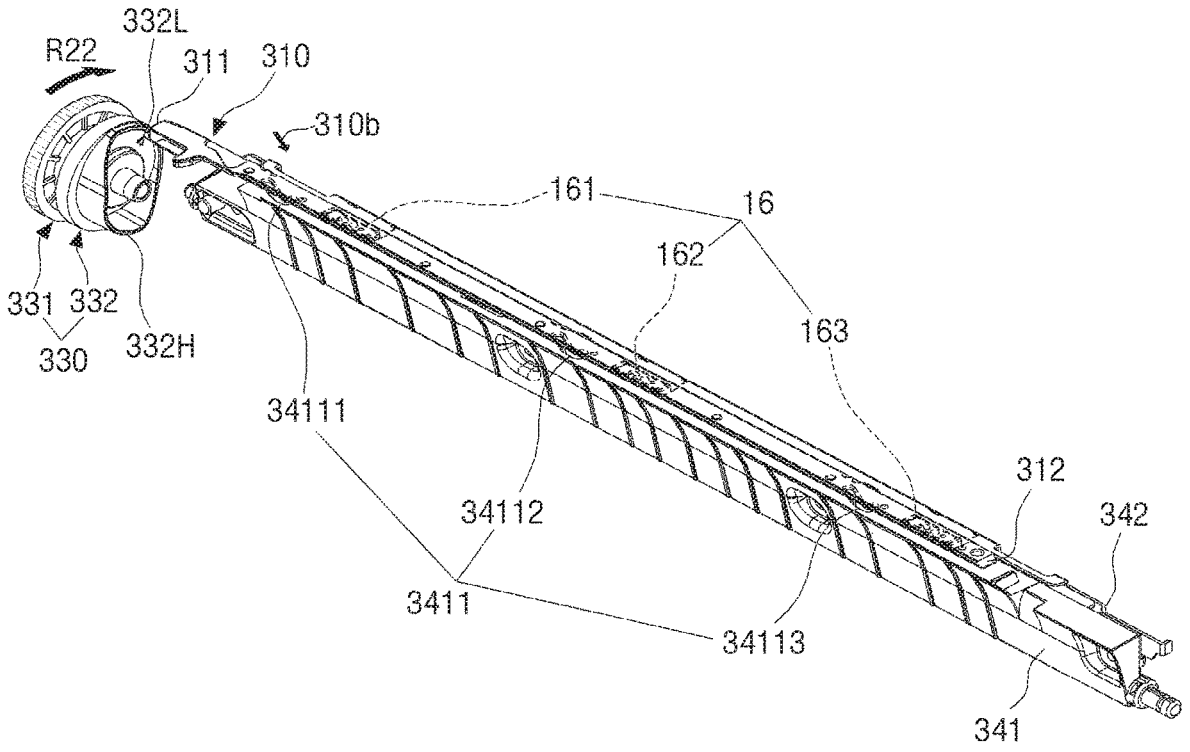
FIG. 10 is a view illustrating a state in which the second shutter part illustrated in FIG. 8 closes sensors according to an example.
Figure 11:
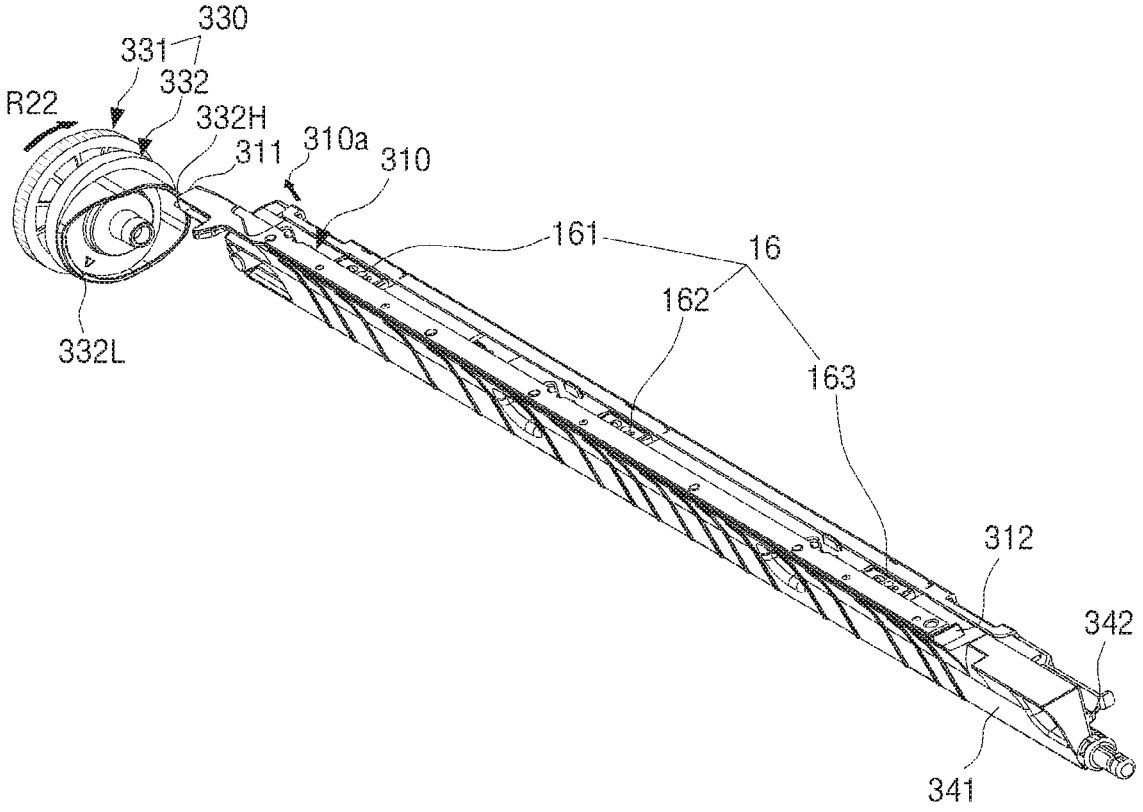
FIG. 11 is a view illustrating a state in which the second shutter part illustrated in FIG. 8 opens the sensors according to an example.

FIG. 8 is a perspective view illustrating the sensing unit 16 and the second shutter part 200 illustrated in FIG. 2 according to an example, FIG. 9 is an exploded perspective view of the sensing unit 16 and the second shutter part 300 illustrated in FIG. 8 according to an example, FIG. 10 is a view illustrating a state in which the second shutter part 300 illustrated in FIG. 8 closes sensors 161 to 163 according to an example, and FIG. 11 is a view illustrating a state in which the second shutter part 300 illustrated in FIG. 8 opens the sensors 161 to 163 according to an example.

Hereinafter, an example of the second shutter part 300 selectively exposing (e.g., opening or closing) the sensors 161 to 163 of the sensing unit 16 will be described with reference to FIGS. 8 to 11.

The sensing unit 16 may include one or more sensors 161 to 163 that may face the transfer belt 151 to sense the color toner image transferred to the transfer belt 151 and the measuring marks for the ACR, and may include first to third sensors 161, 162, and 163 as illustrated in FIG. 9.

The first to third sensors 161 to 163 may be disposed at predetermined intervals in a width direction of the transfer belt 151, perpendicular to the rotation direction of the transfer belt 151. Therefore, the first to third sensors 161 to 163 may sense the color toner image and the measuring marks formed on the transfer belt 151 that rotates.

The first to third sensors 161 to 163 may be disposed to face the transfer belt 151 to perform the ACR, and may sense the measuring marks formed on the transfer belt 151 at the time of an operation in the ACR mode. Since a structure of the first to third sensors 161 to 163 may be the same as or similar to those according to the related art, a description therefor will be omitted.

The second shutter part 300 may include the second cover 310, the second elastic member 320, the second cam gear 330, and the second shutter part body 340.

The first to third sensors 161 to 163 may be disposed in the second shutter part body 340, and may be exposed to face the transfer belt 151 on the upper surface of the second shutter part body 340.

The second shutter part body 340 may include a body housing 341 of which one side is opened and a body housing cover 342 covering the body housing 341.

In addition, as illustrated in FIG. 9, the first to third sensors 161 to 163 are disposed in the body housing 341, and the body housing cover 342 is coupled to the body housing 341, such that the first to third sensors 161 to 163 may be disposed in the second shutter part body 340.

Sensing portions (upper portions) of the first to third sensors 161 to 163 are disposed to be exposed at predetermined intervals on an upper surface of the body housing 341.

The second cover 310 is movably disposed on the body housing 341, that is, on the first to third sensors 161 to 163 to open or close the first to third sensors 161 to 163.

The second cover 310 may have a shape of a plate corresponding to a shape of the upper surface of the body housing 341. The second cover 310 may be extended in a length direction of the upper surface of the body housing 341 in which the first to third sensors 161 to 163 are sequentially disposed, and may be extended from one end 311 in contact with the second cam gear 330 toward another end 312.

The second cover 310 may reciprocate in a second close direction 310*a* in which it covers (i.e., closes) the first to third sensors 161 to 163 and a second open direction 310*b* in which it exposes (i.e., opens) the first to third sensors 161 to 163, on the body housing 341 in which the first to third sensors 161 to 163 are disposed.

As an example, as illustrated in FIG. 9, the second cover 310 may include at least one guide protrusion 313 protruding downward. In addition, the at least one guide protrusion 313 may include first to third guide protrusions 3131, 3132, and 3133.

The body housing 341 may include a guide hole 3411 formed in the upper surface thereof and corresponding to the guide protrusion 313. The guide hole 3411 may include first to third guide holes 34111, 34112, and, 34113 into which the first to third guide protrusions 3131 to 3133 may be inserted, respectively.

The first to third guide holes 34111 to 34113 may be long holes formed in the same shape in the upper surface of the body housing 341, and the first to third guide protrusions 3131 to 3133 may be inserted and slid into the first to third guide holes 34111 to 34113, respectively, to guide the reciprocation of the second cover 310.

As an example, the first to third guide holes 34111 to 34113 may have a shape of a long hole extended in a width direction of the body housing 341 on the upper surface of the body housing 341.

For example, the second cover 310 may close the first to third sensors 161 to 163 in a state in which the first to third guide protrusions 3131 to 3133 are respectively in contact with one end of the first to third guide holes 34111 to 34113. In addition, the first to third guide protrusions 3131 to 3133 may move to the other ends of the first to third guide holes 34111 to 34113 along the first to third guide holes 34111 to 34113, such that the second cover 310 may open the first to third sensors 161 to 163.

Since the second cover 310 may be pressed and move in a length direction of the second cover 310 through the second cam gear 330, the first to third guide holes 34111 to 34113 may have a shape of a long hole inclined at a predetermined angle in the length direction of the second cover 310 for the purpose of smooth reciprocation of the second cover 310.

In an example, since the second close direction 310*a* and the second open direction 310*b* in which the second cover 310 reciprocates correspond to the shape of the first to third guide holes 34111 to 34113, the second close direction 310*a* and the second open direction 310*b* may be inclined at a predetermined angle in the length direction of the second cover 310 depending on the shape of the first to third guide holes 34111 to 34113. However, the shape of the first to third guide holes 34111 to 34113 may be variously modified. The second close direction 310*a* and the second open direction 310*b* in which the second cover 310 reciprocates to open or close the first to third sensors 161 to 163 may also be modified.

When the second cover 310 moves in the second close direction 310*a*, the second cover 310 closes the first to third sensors 161 to 163 as illustrated in FIG. 10, and when the second cover 310 moves in the second open direction 310*b*, the second cover 310 opens the first to third sensors 161 to 163 as illustrated in FIG. 11, such that the first to third sensors 161 to 163 may face the transfer belt 151.

Referring to FIG. 9, the second elastic member 320 may apply an elastic force to the second cover 310 so that the second cover 310 moves in the second close direction 310*a*.

As an example, one end of the second elastic member 320 may be connected to a hooked part 314 disposed at a lower side of the second cover 310, and the other end of the second elastic member 320 may be connected to a hooked part 3412 of the body housing 341. Therefore, the second elastic member 320 may pull the second cover 310 in the second close direction 310*a*. Accordingly, the second elastic member 320 may be a tension spring. In this case, the hooked part 3412 of the body housing 341 may be disposed toward the second close direction 310*a* as compared with the hooked part 314 of the second cover 310.

The body housing 341 may include a hole into which the hooked part 314 of the second cover 310 may be inserted. The second elastic member 320 may apply the elastic force to the hooked part 314 of the second cover 310 in the hole of the body housing 341, and the hooked part 314 of the second cover 310 may move in the hole depending on movement of the second cover 310.

The second elastic member 320 may apply the elastic force to the second cover 310 in the second close direction 310*a* opposed to the second open direction 310*b* so that the second cover 310 maintains a state in which it closes the first to third sensors 161 to 163.

The second cam gear 330 may include the one-way clutch gear 331 to engage and rotate with the driving shaft 120 and may include a second cam 332 coupled to the one-way clutch gear 331.

The one-way clutch gear 331 may include a second gear part 3311 to engage and rotate with the driving gear 121 of the driving shaft 120, and a one-way bearing 3312 coupled to the second gear part 3311.

The second gear part 3311 may rotate in the third rotation direction R21 when the driving shaft 120 rotates in the first rotation direction R11, and may rotate in the fourth rotation direction R22 when the driving shaft 120 rotates in the second rotation direction R12.

The one-way bearing 3312 may connect the second gear part 3311 and the second cam 332 to each other, and may block a transfer of the driving force to the second cam 332 when the second gear part 3311 rotates in the third rotation direction R21 and transfer the driving force to the second cam 332 when the second gear part 3311 rotates in the fourth rotation direction R22. In an example, a structure of the one-way clutch gear 331 including the one-way bearing 3312 may be the same as or similar to that according to the related art.

When the second gear part 3311 rotates in the third rotation direction R21, the transfer of the driving force to the second cam 332 may be blocked by the one-way bearing 3312, such that the second cam 332 does not rotate. In addition, when the second gear part 3311 rotates in the fourth rotation direction R22, the driving force may be transferred to the second cam 332 through the one-way bearing 3312, such that the second cam 332 may rotate in the fourth rotation direction R22.

In an example, the one-way clutch gear 331 may block the transfer of the driving force to the second cam 332 when the driving shaft 120 rotates in the first rotation direction R11, and may transfer the driving force to the second cam 332 when the driving shaft 120 rotates in the second rotation direction R12.

The second cam 332 may have a structure similar to that of the first cam 232. In an example, the second cam 332 may be an edge cam protruding in a direction parallel with a shaft.

The second cam 332 may include a first portion 332L having the lowest phase and a second portion 332H having the highest phase on the basis of a protruding direction.

The first portion 332L and the second portion 332H of the second cam 332, which are portions of a contour curved line of the second cam 332 in contact with one end 311 of the second cover 310, are disposed at an interval of 180° on the basis of a rotation center of the second cam 332.

One end 311 of the second cover 310 in contact with the second cam 332 may be in selective contact with the first portion 332L and the second portion 332H of the second cam 332 depending on the rotation of the second cam 332. When the second cam 332 rotates by 180° in the fourth rotation direction R22 in a state in which one end 311 of the second cover 310 is in contact with the first portion 332L, one end 311 of the second cover 310 may be in contact with the second portion 332H.

As an example, as illustrated in FIG. 10, when one end 311 of the second cover 310 is in contact with the first portion 332L of the second cam 332, the second cover 310 moves in the second close direction 310*a* by the elastic force of the second elastic member 320 to close the first to third sensors 161 to 163.

When the second cam 332 starts to rotate in the fourth rotation direction R22 in the state in which one end 311 of the second cover 310 is in contact with the first portion 332L, the second cam 332 presses one end 311 of the second cover 310 in the second open direction 310*b* to push the second cover 310 in the second open direction 310*b*.

When the second cam 332 rotates by 180° in the state in which one end 311 of the second cover 310 is in contact with the first portion 332L, one end 311 of the second cover 310 may be in contact with the second portion 332H, such that the second cover 310 may open the first to third sensors 161 to 163, as illustrated in FIG. 11.

When the second cam 332 again rotates by 180° in the fourth rotation direction R22 in a state in which the second cover 310 is opened, the second cover 310 may close the first to third sensors 161 to 163, as illustrated in FIG. 10.

In the image forming apparatus 1 according to an example, the second cover 310 may maintain a state in which it closes the first to third sensors 161 to 163 by the elastic force of the second elastic member 320 in the standby mode or during a period in which printing is performed in the printing mode, and when the ACR mode starts, the second cover 310 may open the first to third sensors 161 to 163 through the rotation of the second cam 332 to perform the ACR. When the ACR mode ends, the first to third sensors 161 to 163 may be again closed through the second cover 310.

The first to third sensors 161 to 163 may be opened through the second cover 310 only at the time of an operation, that is, only when the ACR mode is performed, such that pollution of the first to third sensors 161 to 163 due to the toners, dust, and the like, may be reduced or prevented.

Figure 12:
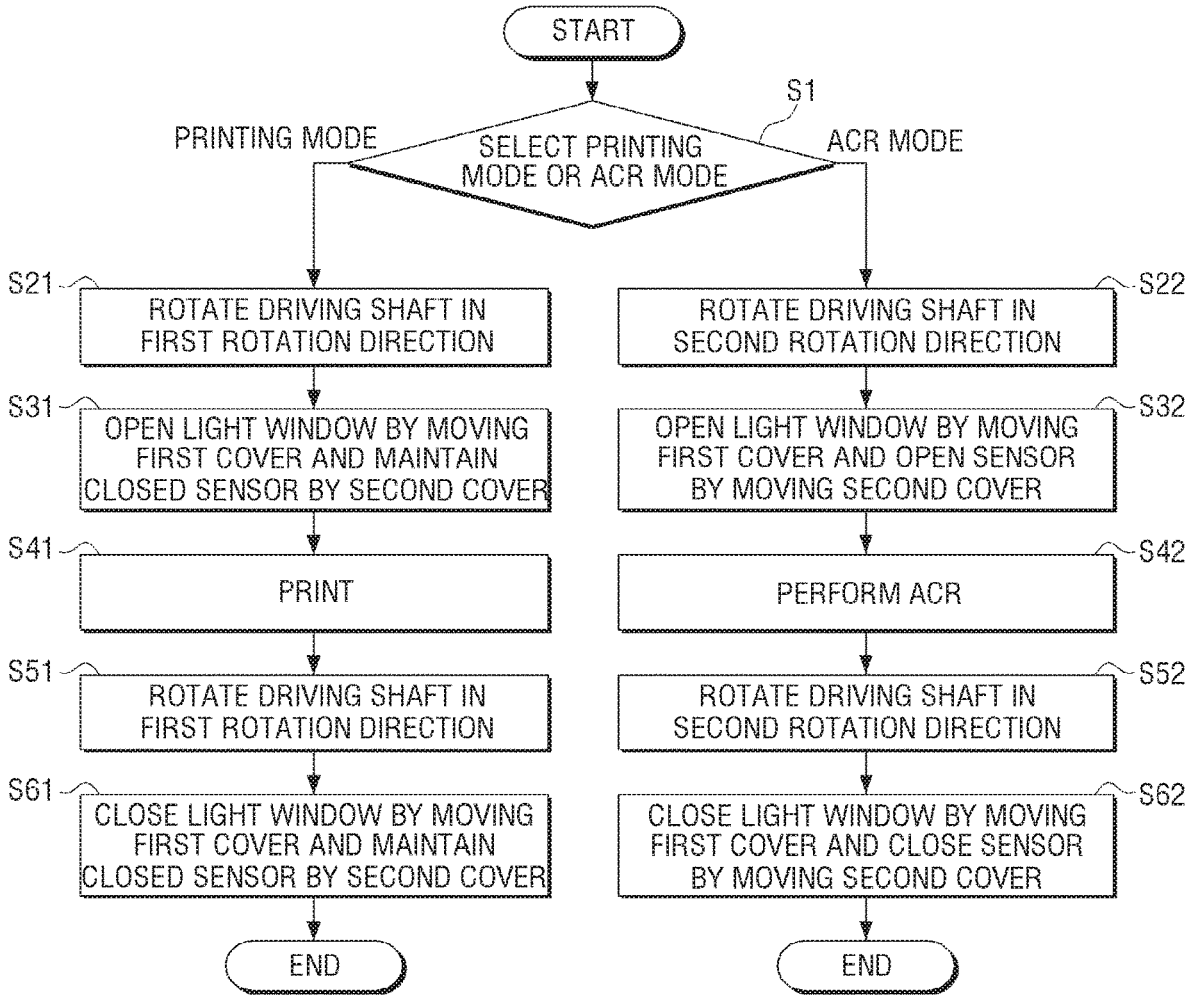
FIG. 12 is a flowchart illustrating a method for controlling an image forming apparatus according to an example.
Figure 13A:
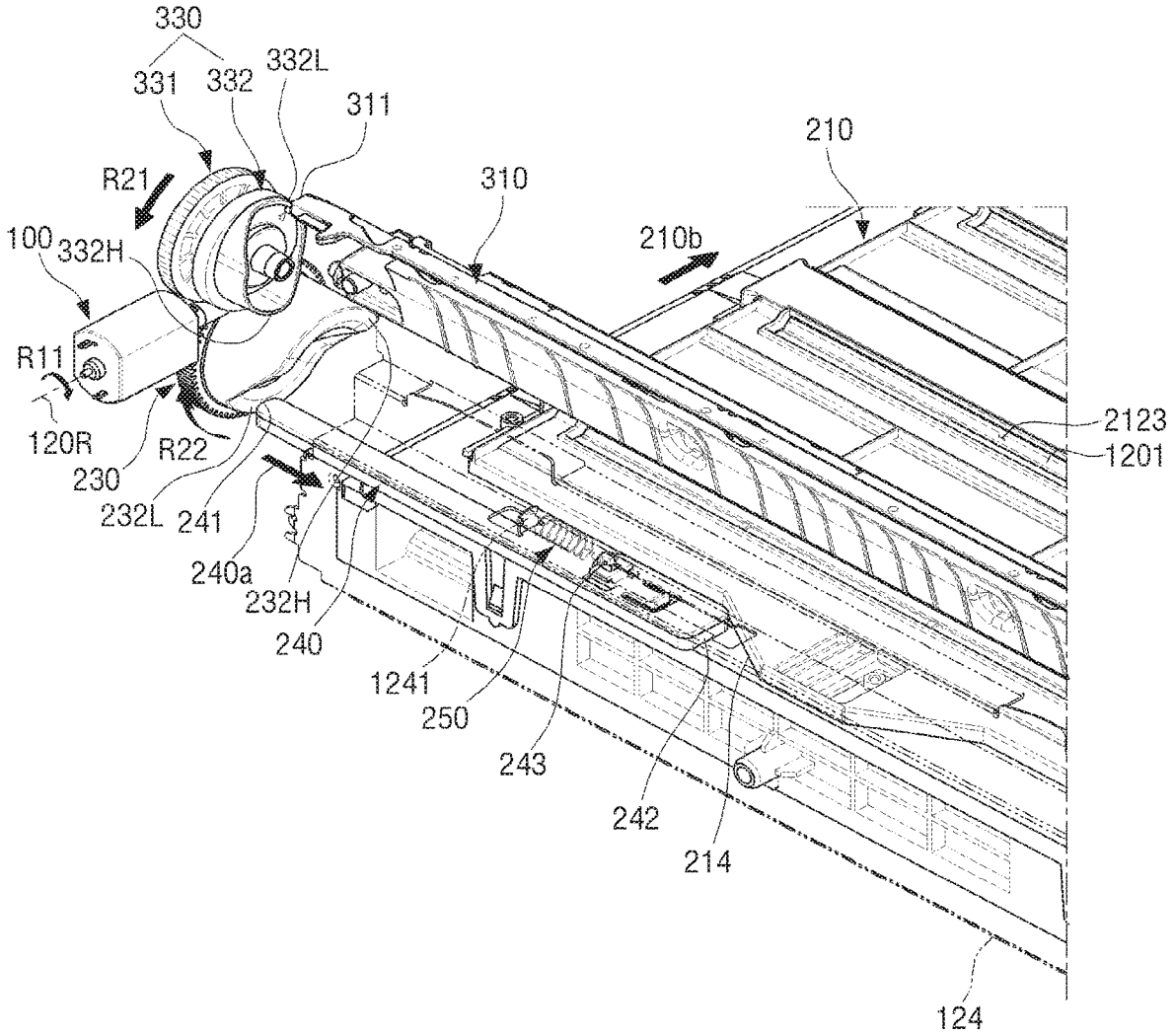
FIGS. 13A to 13C are views illustrating operations of a shutter unit in a printing mode according to an example.
Figure 13B:
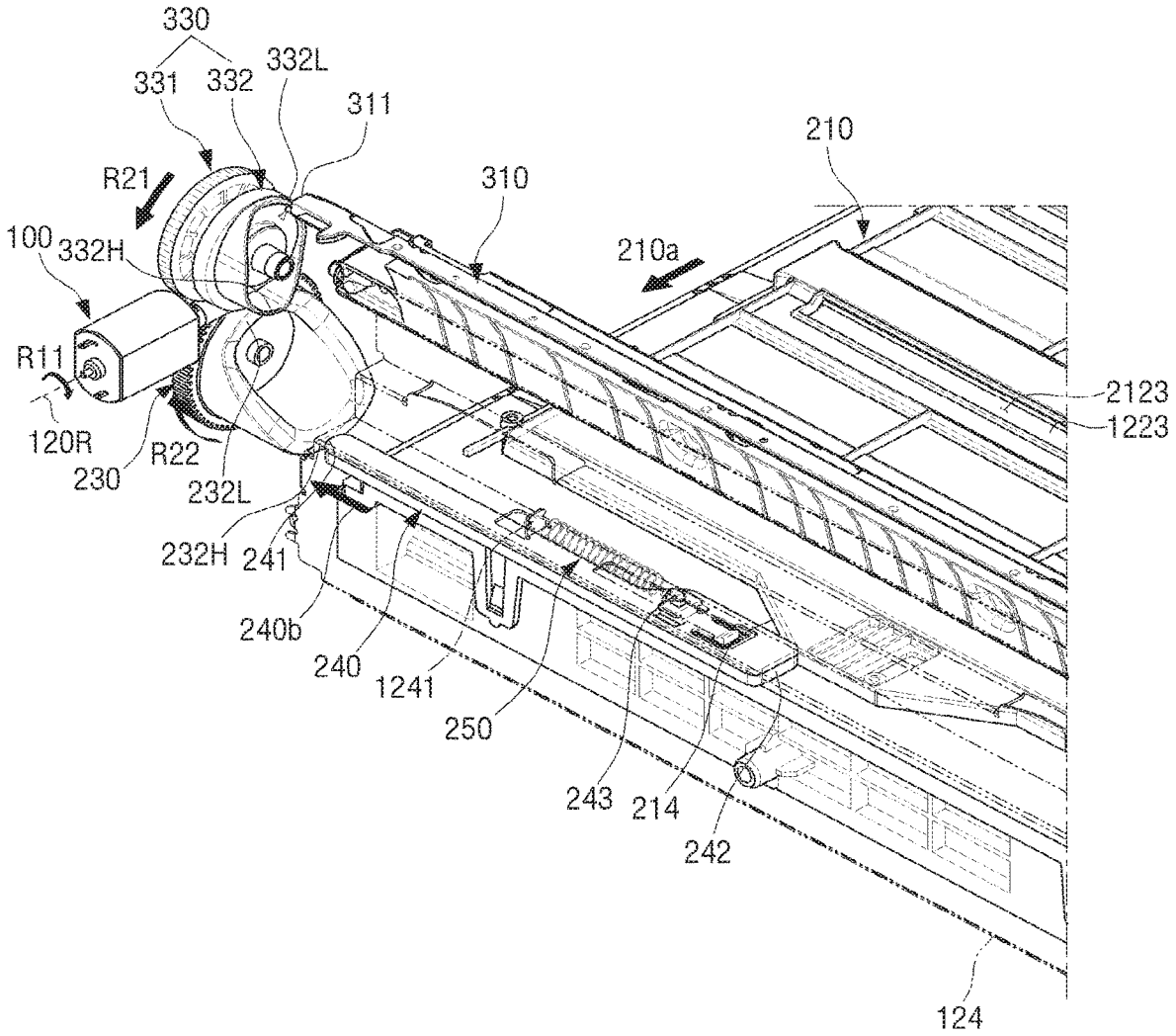
Figure 13C:
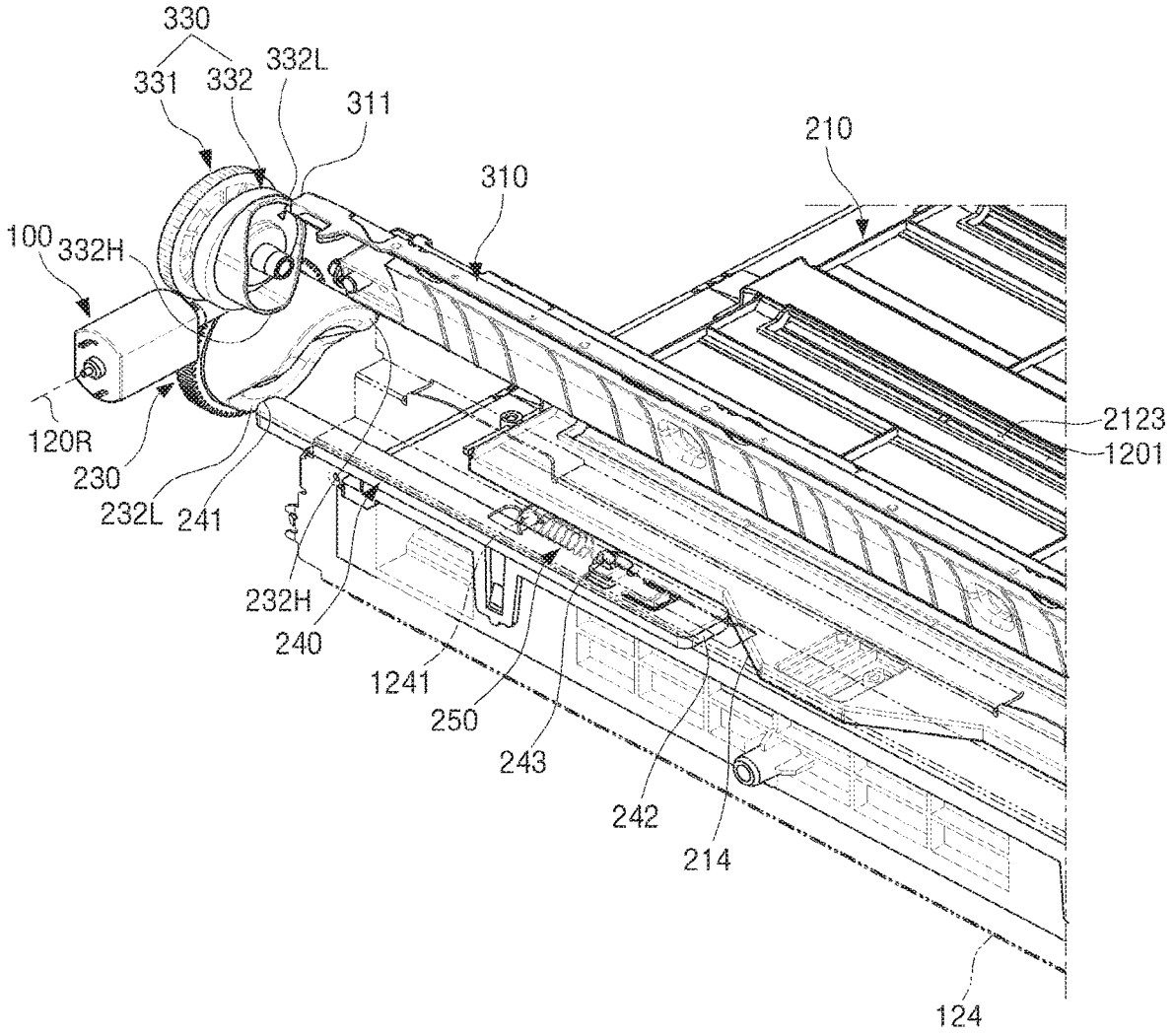
Figure 14A:
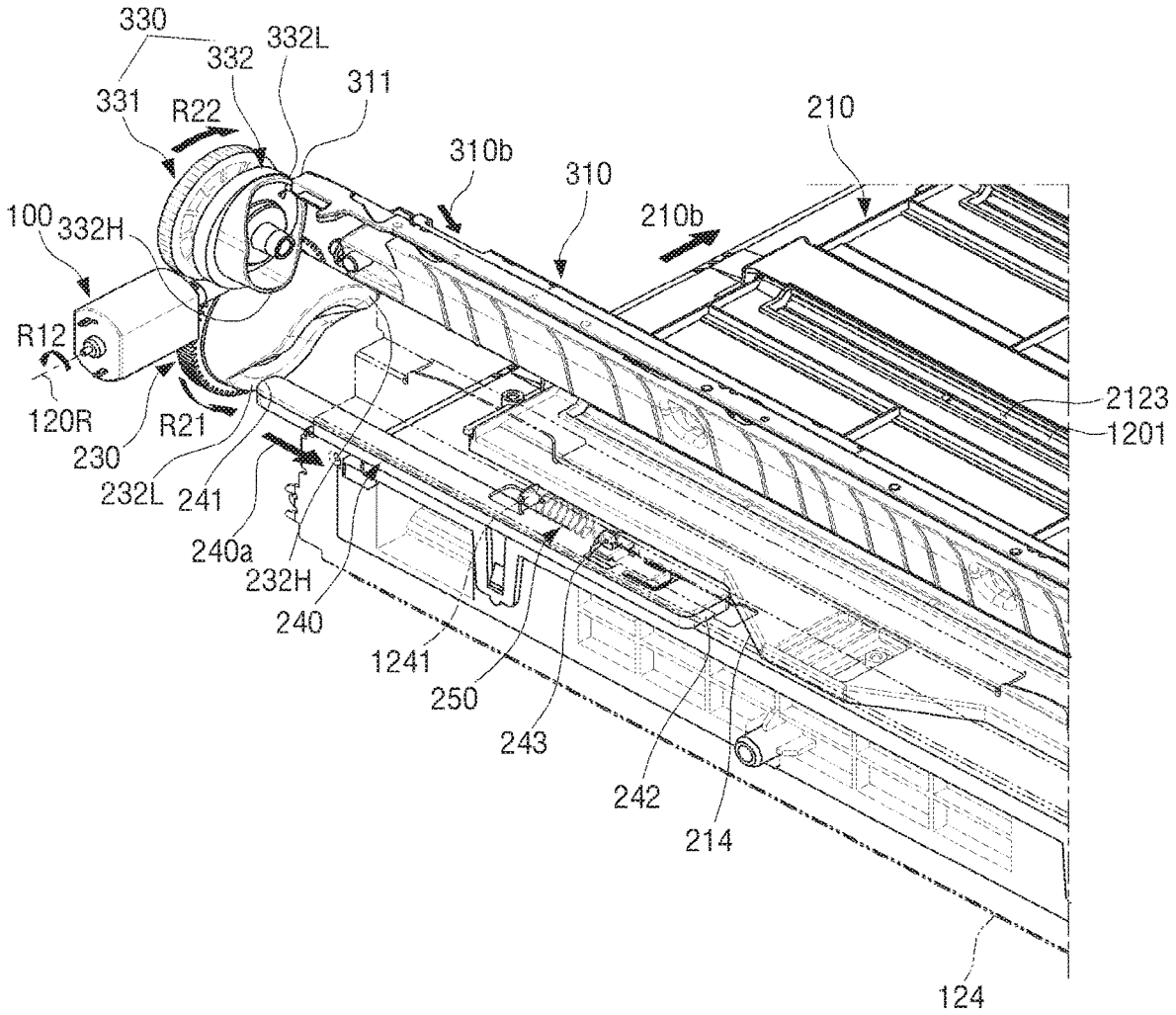
FIGS. 14A to 14C are views illustrating operations of a shutter unit in an auto color registration (ACR) mode according to an example.
Figure 14B:
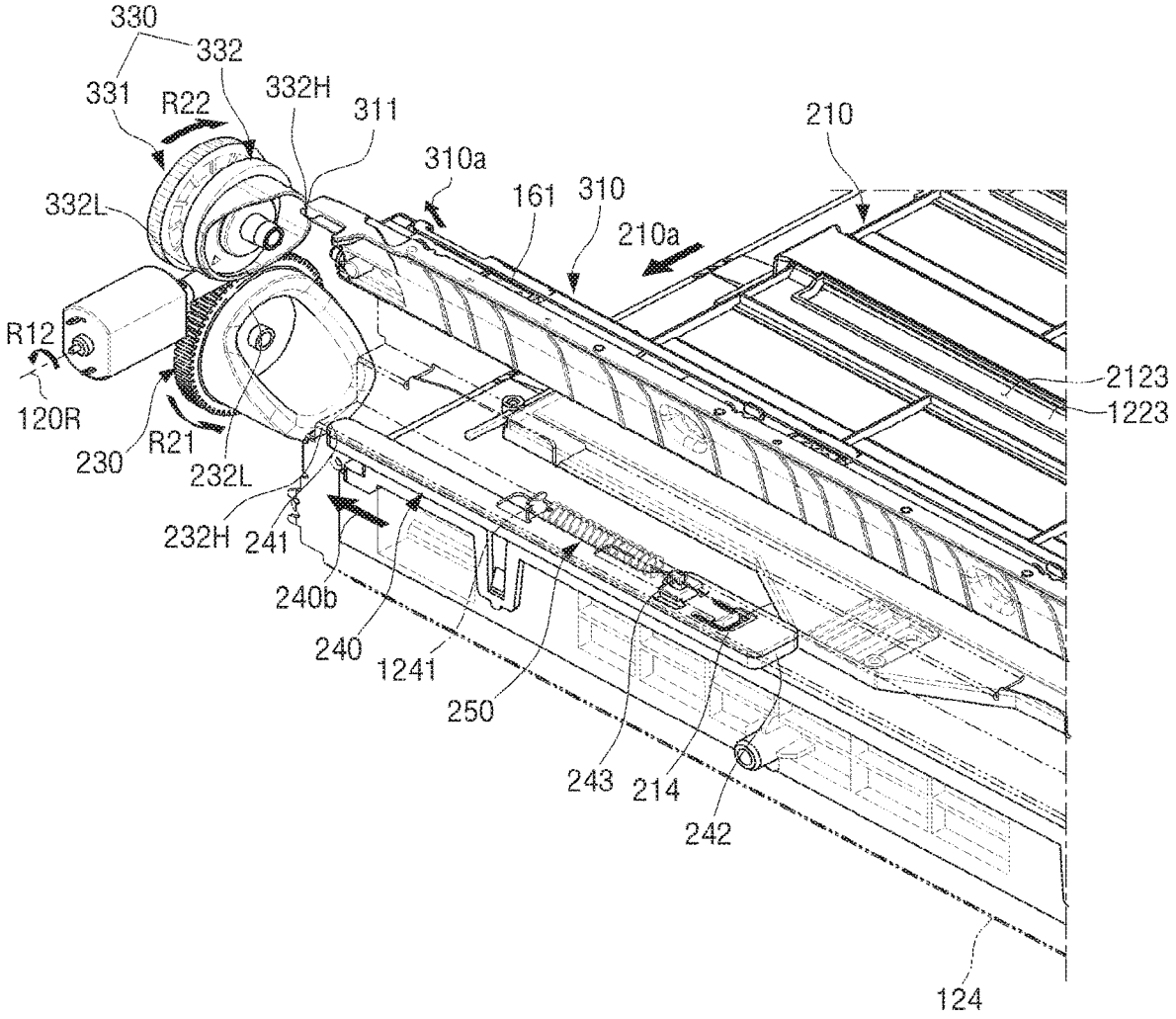
Figure 14C:
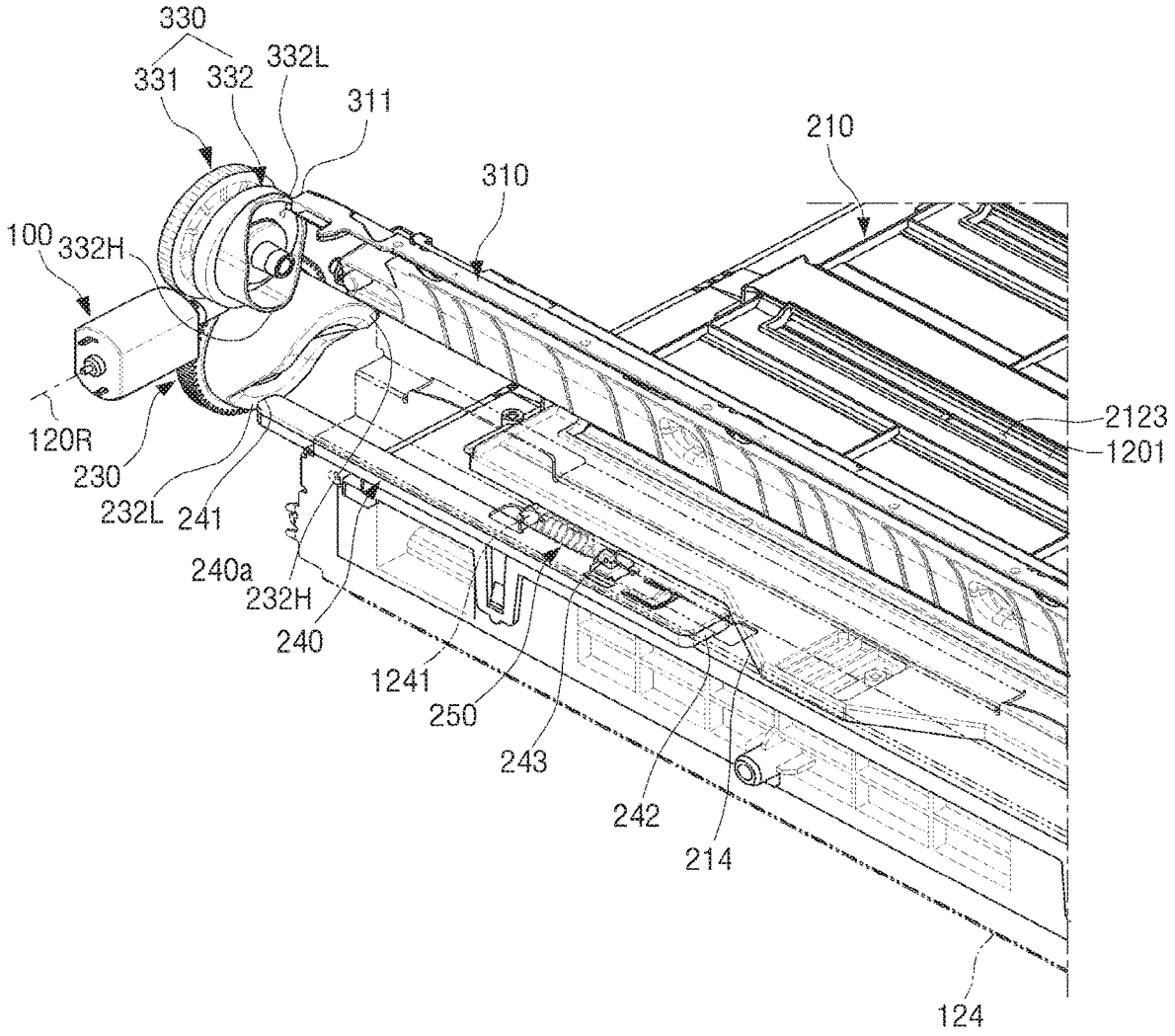

FIG. 12 is a flowchart illustrating a method for controlling an image forming apparatus according to an example, FIGS. 13A to 13C are views illustrating operations of a shutter unit in a printing mode according to an example, and FIGS. 14A to 14C are views illustrating operations of a shutter unit 10 an ACR mode according to an example.

Hereinafter, an example of a method for controlling an image forming apparatus 1 will be described on the basis of operations in which the light window 122 and the sensing unit 16 are opened or closed by the shutter unit 10 with reference to FIGS. 12 to 14C.

The first shutter part 200 opening or closing the first to fourth light windows 1221 to 1224 and the second shutter part 300 opening or closing the first to third sensors 161 to 163 are together engaged with the driving shaft 120 of the motor 100 to receive the driving force transferred from the motor 100.

The first cam gear 230 and the second cam gear 330 engaged and rotating with the driving shaft 120 may have the same gear ratio such that a rotation angle of the first cam gear 230 and a rotation angle of the second cam gear 330 depending on the rotation of the driving shaft 120 may be the same as each other.

As illustrated in FIG. 12, the image forming apparatus 1 may be operated in a printing mode for forming an image on a printing medium and an ACR mode for correcting a color toner image.

A controller (not illustrated) controlling the image forming apparatus 1 may control rotation directions and rotation angles of the driving shaft 120 of the motor 100 depending on operations in the printing mode and the ACR mode to control the first and second shutter part 200 and 300.

Referring to FIG. 12, a printing mode for forming an image on a printing medium and an ACR mode for aligning the toner image transferred to the transfer belt 151 of the transfer unit 15 may be selected in operation 51.

The image forming apparatus 1 may be generally operated in the printing mode for forming an image on the printing medium.

In a case in which the developing unit 14 is replaced, the image forming apparatus 1 performs a large amount of printing, or the image forming apparatus 1 is not operated for a long period of time, the image forming apparatus 1 may be operated in the ACR mode.

The controller may sense that the developing unit 14 is replaced, the image forming apparatus 1 performs the large amount of printing, or the image forming apparatus 1 was in the standby mode for the long period of time to automatically select the ACR mode. In addition, the ACR mode may be performed before a start of the printing mode, after an end of the printing mode, or during printing.

In the image forming apparatus 1 in a standby mode state, as illustrated in FIGS. 13A, 13C, 14A, and 14C, one end 241 of the first lever 240 is in contact with the first portion 232L of the first cam 232, and one end 311 of the second cover 310 is in contact with the first portion 332L of the second cam 332. Therefore, the first cover 210 and the second cover 310 may stand by in a state in which the first cover 210 closes the first to fourth light windows 1221 to 1224, and the second cover 310 closes the first to third sensors 161 to 163.

When a printing mode starts from the standby mode, the controller may rotate the driving shaft 120 of the motor 100 in the first rotation direction R11 in operation S21.

The controller may rotate the driving shaft 120 in the first rotation direction R11 to rotate the first cam gear 230 in the fourth rotation direction R22.

The first cover 210 of the first shutter part 200 may open the first to fourth light windows 1221 to 1224 of the exposing unit 12 through the driving force of the driving shaft 120, and the driving force of the driving shaft 120 transferred to the second shutter part 300 is blocked, such that the second shutter part 300 maintains a position at which the second cover 310 closes the first to third sensors 161 to 163 in operation S31.

As an example, the first cam gear 230 may rotate in the fourth rotation direction R22 due to the rotation of the driving shaft 120 in the first rotation direction R11, such that one end 241 of the first lever 240 in a state in which it is in contact with the first portion 232L of the first cam 232 is pushed in the first direction 240*a*. The other end 242 of the first lever 240 moving in the first direction 240*a* may push the inclined part 214 of the first cover 210, such that the first cover 210 moves in the first open direction 210*b*.

As illustrated in FIG. 13B, the first cam gear 230 rotates by 180° in a state of FIG. 13A, such that one end 241 of the first lever 240 is in contact with the second portion 232H of the first cam 232, and the first cover 210 opens the first to fourth light windows 1221 to 1224.

The controller may control the motor 100 so that the driving shaft 120 does not rotate during a period in which the printing is performed, thereby maintaining a state in which the first to fourth light windows 1221 to 1224 are opened.

When the driving shaft 120 rotates in the first rotation direction R11, the one-way clutch gear 331 of the second cam gear 330 may rotate in the third rotation direction R21.

In a case in which the one-way clutch gear 331 rotates in the third rotation direction R21, the one-way clutch gear 331 blocks the driving force transferred to the second cam 332 through the one-way bearing 3312, such that the second cam 322 does not rotate, but stands by.

As illustrated in FIG. 13B, even though the first cam 232 rotates by 180° due to the rotation of the driving shaft 120 in the first rotation direction R11, the second cam 332 does not rotate, but may maintain a position in the standby mode. Therefore, the second cover 310 maintains a state in which it closes the first to third sensors 161 to 163.

The image forming apparatus 1 performs the printing in operation S41.

In a case in which the image forming apparatus 1 is operated in the printing mode, the first to fourth light windows 1221 and 1224 are opened through the first cover 210, such that the electrostatic latent images may be formed on the first to fourth photoreceptors 131 to 134.

In a case in which the image forming apparatus 1 is operated in the printing mode, the transfer of the driving force to the second shutter part 300 is blocked through the one-way clutch gear 331, such that the second cover 310 may maintain the state in which it closes the first to third sensors 161 to 163. Therefore, the first to third sensors 161 to 163 that are not operated in the printing mode are maintained in a state in which they are closed by the second cover 310, such that pollution of the first to third sensors 161 to 163 due to pollutants such as the toners, and the like, may be effectively reduced prevented.

When the printing mode ends, the controller rotates the driving shaft 120 in the first rotation direction R11 in operation S51.

The first cover 210 closes the first to fourth light windows 1221 to 1224 through the driving force of the driving shaft 120, and the driving force of the driving shaft 120 transferred to the second shutter part 300 is blocked, such that the second cover 310 maintains a position at which it closes the first to third sensors 161 to 163 in operation S61.

As an example, the first cam gear 230 rotates in the fourth rotation direction R22 due to the rotation of the driving shaft 120 in the first rotation direction R11, such that one end 241 of the first lever 240 in a state in which it is in contact with the second portion 232H of the first cam 232 is released from being pressed from the first cam 232.

The first lever 240 moves in the second direction 240*b* by the elastic force of the lever elastic member 250, and the first cover 210 moves in the first close direction 210*a* by the elastic force of the first elastic member 220.

As illustrated in FIG. 13C, the first cam gear 230 again rotates by 180° in a state of FIG. 13B, such that one end 241 of the first lever 240 is in contact with the first portion 232L of the first cam 232. Therefore, the first cover 210 closes the first to fourth light windows 1221 to 1224.

When the driving shaft 120 rotates in the first rotation direction R11, the one-way clutch gear 331 of the second cam gear 330 rotates in the third rotation direction R21, and the driving force transferred to the second cam 332 is blocked through the one-way bearing 3312, such that the second cam 332 does not rotate.

As illustrated in FIG. 13C, even though the first cam 232 again rotates by 180° due to the rotation of the driving shaft 120 in the first rotation direction R11, the second cam 332 does not rotate, but may maintain a position in the standby mode. Therefore, the second cover 310 maintains a state in which it closes the first to third sensors 161 to 163.

The controller controls the motor 100 so that the driving shaft 120 does not rotate after the first to fourth light windows 1221 to 1224 are closed by the first cover 210 due to an end of the printing mode, such that the image forming apparatus 1 may enter the standby mode in a state in which the first to fourth light windows 1221 to 1224 and the first to third sensors 161 to 163 are closed.

When the ACR mode starts, such as from the standby mode of the image forming apparatus 1, the controller rotates the driving shaft 120 of the motor 100 in the second rotation direction R12 in operation S22.

The controller may rotate the driving shaft 120 in the second rotation direction R12 to rotate the first cam gear 230 in the third rotation direction R21.

Through the driving force of the driving shaft 120, the first cover 210 of the first shutter part 200 moves to open the first to fourth light windows 1221 to 1224 of the exposing unit 12, and the second cover 310 of the second shutter part 300 moves to open the first to third sensors 161 to 163 in operation S32.

As an example, the first cam gear 230 rotates in the third rotation direction R21 due to the rotation of the driving shaft 120 in the second rotation direction R12, such that one end 241 of the first lever 240 in a state in which it is in contact with the first portion 232L of the first cam 232 is pushed in the first direction 240*a*. The other end 242 of the first lever 240 moving in the first direction 240*a* pushes the inclined part 214 of the first cover 210, such that the first cover 210 moves in the first open direction 210*b*.

As illustrated in FIG. 14B, the first cam gear 230 rotates by 180° in a state of FIG. 14A, such that one end 241 of the first lever 240 is in contact with the second portion 232H of the first cam 232, and the first cover 210 opens the first to fourth light windows 1221 to 1224.

When the driving shaft 120 rotates in the second rotation direction R12, the first cam gear 230 rotates in the third rotation direction R21, and at the same time, the one-way clutch gear 331 of the second cam gear 330 rotates in the fourth rotation direction R22.

In a case in which the one-way clutch gear 331 rotates in the fourth rotation direction R22, the one-way bearing 3312 transfers the driving force to the second cam 332, such that the second cam 332 also rotates in the fourth rotation direction R22.

One end 331 of the second cover 310 in a state in which it is in contact with the first portion 332L of the second cam 332 is pushed in the second open direction 310*b*, such that the second cover 310 moves in the second open direction 310*b*.

As illustrated in FIG. 14B, the second cam gear 330 rotates by 180° in a state of FIG. 14A, such that one end 311 of the second cover 310 is in contact with the second portion 332H of the second cam 332, and the second cover 310 thus opens the first to third sensors 161 to 163.

The controller controls the motor 100 so that the driving shaft 120 does not rotate during a period in which the ACR mode progresses. Therefore, the first to fourth light windows 1221 to 1224 are maintained in an open state.

In the ACR mode, the exposing unit 12 may form electrostatic latent images for predetermined measuring marks on the first to fourth photoreceptors 131 to 134 through the first to fourth light windows 1221 to 1224, and may form predetermined measuring marks for the ACR on the transfer belt 151.

The image forming apparatus 1 performs the ACR in operation S42.

The first to third sensors 161 to 163 are opened, such that the first to third sensors 161 to 163 may sense the measuring marks formed on the transfer belt 151 and thus perform alignment and correction on the color toner image.

When the ACR mode ends, the controller rotates the driving shaft 120 in the second rotation direction R12 in operation S52.

Through the driving force of the driving shaft 120, the first cover 210 moves in the first close direction 210*a* to close the first to fourth light windows 1221 to 1224, and the second cover 310 moves in the second close direction 310*a* to close the first to third sensors 161 to 163 in operation S62.

As an example, the first cam gear 230 rotates in the third rotation direction R21 due to the rotation of the driving shaft 120 in the second rotation direction R12, such that one end 241 of the first lever 240 in a state in which it is in contact with the second portion 232H of the first cam 232 is released from being pressed from the first cam 232.

The first lever 240 moves in the second direction 240*b* by the elastic force of the lever elastic member 250, and the first cover 210 moves in the first close direction 210*a* by the elastic force of the first elastic member 220.

As illustrated in FIG. 14C, the first cam gear 230 again rotates by 180° in a state of FIG. 14B, such that one end 241 of the first lever 240 is in contact with the first portion 232L of the first cam 232, and the first cover 210 thus closes the first to fourth light windows 1221 to 1224.

When the driving shaft 120 rotates in the second rotation direction R12, the one-way clutch gear 331 of the second cam gear 330 rotates in the fourth rotation direction R22, and the driving force is transferred to the second cam 332 through the one-way bearing 3312, such that the second cam 332 also rotates in the fourth rotation direction R22.

As illustrated in FIG. 14C, the first and second cams 232 and 332 again rotate by 180° due to the rotation of the driving shaft 120 in the first rotation direction R12, such that the first to third sensors 161 to 163 are closed.

The controller may control the motor 100 so that the driving shaft 120 does not rotate after the first to fourth light windows 1221 to 1224 and the first to third sensors 161 to 163 are closed due to an end of the ACR mode, thereby allowing the image forming apparatus 1 to enter the standby mode.

As described above, in the image forming apparatus 1 according to an example, the first and second shutter parts 200 and 300 are connected together to the driving shaft 120 of the motor 100, and the driving force is transferred from the motor 100 to the first and second shutter parts 200 and 300, such that the first and second shutter parts 200 and 300 may be driven using only the single motor 100. Therefore, the image forming apparatus 1 including the first and second shutter parts 200 and 300 may have a compact structure.

The second shutter part 300 may selectively rotate the second cam 332 depending on a rotation direction of the driving shaft 120 through the one-way clutch gear 331 to selectively open the first to third sensors 161 to 163.

The image forming apparatus 1 may select a printing mode of maintaining a state in which the first to fourth light windows 1221 to 1224 are opened or closed and the first to third sensors 161 to 163 are closed and may select an ARC mode in which the first to fourth light windows 1221 to 1224 and the first to third sensors 161 to 163 are simultaneously opened or closed by only a simple control that changes the rotation direction of the driving shaft 120, and be operated in the selected mode.

The first and second cam gears 230 and 330 may have the same gear ratio, such that they simultaneously rotate at the same rotation angle, and may thus indirectly sense an open or close state of the first cover 210 through the first to third sensors 161 to 163.

As an example, the first cam gear 230 and the second cam gear 330 may have the same gear ratio, such that the rotation angle of the first cam gear 230 and the rotation angle of the second cam gear 330 may be the same as each other.

An amount of light sensed by the first to third sensors 161 to 163 becomes a maximum or a minimum when the first to third sensors 161 to 163 are opened or closed by the second cover 310 due to the rotation of the driving shaft 120 in the second rotation direction R12.

The controller may decide that a point in time in which an amount of light sensed by the first to third sensors 161 to 163 becomes maximum or minimum is a point in time in which the first to fourth light windows 1221 to 1224 are opened or closed by the first cover 210.

In an example, in the operation in the ACR mode, the controller may decide that a point in time in which an amount of light introduced into the first to third sensors 161 to 163 becomes maximum is a point in time in which the first to third sensors 161 to 163 and the first to fourth light windows 1221 to 1224 are opened. Therefore, the controller may control the motor 100 so that the driving shaft 120 stops, thereby performing the ACR mode.

As the driving shaft 120 rotates in the second rotation direction R12 due to an end of the ACR mode, the controller may decide that a point in time in which an amount of light sensed by the first to third sensors 161 to 163 becomes minimum is a point in time in which the first to third sensors 161 to 163 and the first to fourth light windows 1221 to 1224 are closed. Therefore, the controller may control the motor 100 so that the driving shaft 120 stops, thereby allowing the image forming apparatus 1 to enter the standby mode, or may change the rotation direction of the driving shaft 120 into the first rotation direction R11, thereby starting the printing mode.

The shutter unit 10 may accurately decide whether the first to fourth light windows 1221 to 1224 are opened or closed by the first cover 210 and the first to third sensors 161 to 163 are opened or closed by the second cover 310 through the sensing unit 16 without using a separate sensor for sensing states of the first and second covers 210 and 310.

Since the shutter unit 10 may perform the driving and the control on the first and second shutter parts 200 and 300 in the printing mode and the ACR mode through the single motor 100, the pollution of the first to fourth light windows 1221 to 1224 and the first to third sensors 161 to 163 may be effectively reduced or prevented by using the shutter unit 10 having a simple structure.

An entire size of the image forming apparatus 1 including the shutter unit 10 may be reduced, a structure of the image forming apparatus 1 may become compact, and a cost required for manufacturing the image forming apparatus 1 may be efficiently reduced.

Although diverse examples have been individually described hereinabove, the respective examples are not necessarily implemented singly, but may also be implemented so that configurations and operations thereof are combined with those of one or more other exemplary embodiments.

Although examples of the present disclosure have been illustrated and described hereinabove, the present disclosure is not limited to the examples described above, but may be variously modified by those skilled in the art to which the present disclosure pertains without departing from the scope and spirit of the disclosure as claimed in the claims. These modifications should also be understood to fall within the technical spirit and scope of the present disclosure.

What is claimed is:

1. A shutter unit comprising:

a motor including a driving shaft to rotate in a first rotation direction and to rotate in a second rotation direction opposed to the first rotation direction;

a first shutter part to selectively expose a light window by receiving a driving force transferred from the driving shaft when the driving shaft rotates in the first rotation direction or rotates in the second rotation direction; and a second shutter part to selectively expose a sensor by receiving the driving force transferred from the driving shaft when the driving shaft rotates in the second rotation direction.

2. The shutter unit as claimed in claim 1, wherein the first shutter part includes:

a first cover disposed on the light window to reciprocate between a first close direction in which the first cover covers the light window and a first open direction in which the first cover exposes the light window;

a first elastic member to apply an elastic force to the first cover to move the first cover in the first close direction; and a first cam gear to engage and rotate with the driving shaft and push the first cover in the first open direction.

3. The shutter unit as claimed in claim 2, wherein the first cam gear includes:

a first gear part to engage and rotate with the driving shaft; and a first cam to be coupled to the first gear part.

4. The shutter unit as claimed in claim 3, wherein the first cam comprises an edge cam protruding in a direction parallel with a shaft of the first cam gear.

5. The shutter unit as claimed in claim 2, wherein the first shutter part further includes a first lever having one end in contact with the first cam gear and another end in contact with the first cover to reciprocate based on a rotation of the first cam gear, and wherein the first lever reciprocates in a first direction in which the first lever pushes the first cover in the first open direction and a second direction opposed to the first direction.

6. The shutter unit as claimed in claim 5, wherein the first shutter part further includes a lever elastic member to apply an elastic force to the first lever so that the first lever moves in the second direction.

7. The shutter unit as claimed in claim 2, wherein the second shutter part includes:

a second cover disposed on the sensor to reciprocate between a second close direction in which the second cover covers the sensor and a second open direction in which the second cover exposes the sensor;

a second elastic member to apply an elastic force to the second cover so that the second cover moves in the second close direction; and a second cam gear to engage and rotate with the driving shaft and push the second cover in the second open direction, wherein the second cam gear includes:

a one-way clutch gear to engage and rotate with the driving shaft; and a second cam to rotate by receiving the driving force transferred from the one-way clutch gear to push the second cover in the second open direction, and wherein the one-way clutch gear is to block a transfer of the driving force to the second cam when the driving shaft rotates in the first rotation direction, and to transfer the driving force to the second cam when the driving shaft rotates in the second rotation direction.

8. The shutter unit as claimed in claim 7, wherein the second cam comprises an edge cam protruding in a direction parallel with a shaft of the second cam gear.

9. The shutter unit as claimed in claim 7, wherein the first cam gear and the second cam gear have the same gear ratio.

10. The shutter unit as claimed in claim 1, further comprising a controller to:

control the first shutter part and the second shutter part to respectively cover the light window and the sensor in a standby mode, control the motor so that the light window is exposed by rotating the driving shaft in the first rotation direction when a printing mode starts, and control the motor so that the light window is covered by rotating the driving shaft in the first rotation direction when the printing mode ends.

11. The shutter unit as claimed in claim 10, wherein the controller is further to:

control the motor so that the light window and the sensor are exposed by rotating the driving shaft in the second rotation direction when an auto color registration (ACR) mode starts, and control the motor so that the light window and the sensor are covered by rotating the driving shaft in the second rotation direction when the ACR mode ends.

12. A method for controlling an image forming apparatus, the method comprising:

selecting a printing mode for forming an image on a printing medium or an auto color registration (ACR) mode for aligning a toner image transferred to a transfer unit;

rotating a driving shaft of a motor in a first rotation direction when the printing mode starts;

exposing a light window of an exposing unit by moving a first cover of a first shutter part through a driving force of the driving shaft, and blocking the driving force of the driving shaft transferred to a second shutter part so that a second cover of the second shutter part maintains a position at which the second cover covers a sensor;

rotating the driving shaft in the first rotation direction when the printing mode ends; and covering the light window by moving the first cover through the driving force of the driving shaft, and blocking the driving force of the driving shaft transferred to the second shutter part so that the second cover maintains the position at which the second cover covers the sensor.

13. The method as claimed in claim 12, further comprising:

rotating the driving shaft of the motor in a second rotation direction when the ACR mode starts;

exposing the light window of the exposing unit by moving the first cover of the first shutter part and exposing the sensor by moving the second cover of the second shutter part, through the driving force of the driving shaft;

rotating the driving shaft in the second rotation direction when the ACR mode ends; and covering the light window by moving the first cover and covering the sensor by moving the second cover, through the driving force of the driving shaft.

14. An image forming apparatus comprising:

an exposing unit including a light window to transmit light emitted from a light source;

a sensing unit including a sensor; and a shutter unit to selectively expose the light window and the sensor, wherein the shutter unit includes:

a motor including a driving shaft to rotate in a first rotation direction and to rotate in a second rotation direction opposed to the first rotation direction;

a first shutter part to selectively expose the light window by receiving a driving force transferred from the driving shaft when the driving shaft rotates in the first rotation direction or rotates in the second rotation direction; and a second shutter part to selectively expose the sensor by receiving the driving force transferred from the driving shaft when the driving shaft rotates in the second rotation direction.

15. The image forming apparatus as claimed in claim 14, further comprising:

a photoreceptor;

a developing unit to supply a toner to the photoreceptor on which an electrostatic latent image is formed to form a toner image; and a transfer unit to have the toner image from the photoreceptor transferred thereto and to transfer the toner image to a printing medium, wherein the exposing unit including the light window transmits the light emitted from the light source to the photoreceptor to form the electrostatic latent image on the photoreceptor; and wherein the sensor included in the sensing unit faces the transfer unit to sense the toner image transferred to the transfer unit.

16. The image forming apparatus as claimed in claim 14, wherein the first shutter part includes:

a first cover disposed on the light window to reciprocate between a first close direction in which the first cover covers the light window and a first open direction in which the first cover exposes the light window;

a first elastic member to apply an elastic force to the first cover to move the first cover in the first close direction; and a first cam gear to engage and rotate with the driving shaft and push the first cover in the first open direction.

17. The image forming apparatus as claimed in claim 16, wherein the first cam gear includes:

a first gear part to engage and rotate with the driving shaft; and a first cam to be coupled to the first gear part.

18. The image forming apparatus as claimed in claim 17, wherein the first cam comprises an edge cam protruding in a direction parallel with a shaft of the first cam gear.

19. The image forming apparatus as claimed in claim 16, wherein the first shutter part further includes a first lever having one end in contact with the first cam gear and another end in contact with the first cover to reciprocate based on a rotation of the first cam gear, and wherein the first lever reciprocates in a first direction in which the first lever pushes the first cover in the first open direction and a second direction opposed to the first direction.

20. The image forming apparatus as claimed in claim 19, wherein the first shutter part further includes a lever elastic member to apply an elastic force to the first lever so that the first lever moves in the second direction.

* * * * *